US008008565B2

(12) United States Patent
Nishibori et al.

(10) Patent No.: US 8,008,565 B2
(45) Date of Patent: Aug. 30, 2011

(54) PERFORMANCE APPARATUS AND TONE GENERATION METHOD

(75) Inventors: Yu Nishibori, Hamamatsu (JP); Toshio Iwai, Mitaka (JP)

(73) Assignee: Yamaha Corporation (JP)

( * ) Notice: Subject to any disclaimer, the term of this patent is extended or adjusted under 35 U.S.C. 154(b) by 0 days.

(21) Appl. No.: 12/582,830

(22) Filed: Oct. 21, 2009

(65) Prior Publication Data

US 2010/0037754 A1 Feb. 18, 2010

Related U.S. Application Data

(63) Continuation of application No. 11/681,899, filed on Mar. 5, 2007, now Pat. No. 7,709,724.

(30) Foreign Application Priority Data

Mar. 6, 2006 (JP) ..... 2006-059957

(51) Int. Cl.
*G10H 1/34* (2006.01)
*G10H 7/06* (2006.01)

(52) U.S. Cl. ..... 84/606; 84/604; 84/644; 84/745

(58) Field of Classification Search ..... 84/601–604, 84/606, 609, 614, 615, 616, 618, 626, 633, 84/644, 718, 743, 745, DIG. 7, 290, 464 R, 84/464 A See application file for complete search history.

(56) References Cited

U.S. PATENT DOCUMENTS 3,562,394 A 2/1971 Kiepe
4,031,800 A 6/1977 Thompson
4,089,246 A 5/1978 Kooker
4,123,960 A 11/1978 Franzmann
4,384,503 A 5/1983 Gunn
4,422,365 A 12/1983 Iwaki
5,027,689 A 7/1991 Fujimori
5,088,378 A 2/1992 DeLaTorre
5,247,864 A 9/1993 Konishi (Continued)

FOREIGN PATENT DOCUMENTS

DE 100 42 300 A1 3/2002

(Continued)

OTHER PUBLICATIONS

Notice of Ground for Rejection issued in corresponding Japanese Patent Application No. 2006-059957 mailed Sep. 16, 2008.

(Continued)

*Primary Examiner* — Jeffrey Donels
*Assistant Examiner* — Andrew R Millikin
(74) *Attorney, Agent, or Firm* — Rossi, Kimms & McDowell LLP

(57) ABSTRACT

Plural key switches are arranged in two dimensions along X- and Y-coordinate axes, and an X-coordinate position of each of the key switches is associated with tone generation timing while a Y-coordinate position of each of the key switches is associated with a tone pitch. Storage section stores a music piece data set that includes tone generating data having data of tone pitches and tone generation timing associated with the key switches. In a repeat-section setting mode, a repeat-section setting section causes the plural key switches to function as setting operators and sets a repeat section of the music piece data set on the basis of the X-coordinate position of any operated one of the key switches. In reproduction of the stored music piece data set, a reproduction section repetitively reproduces the tone generating data of the music piece data set which are included in the set repeat section.

6 Claims, 19 Drawing Sheets

U.S. PATENT DOCUMENTS

| | | | |
|---|---|---|---|
| 5,530,898 | A | 6/1996 | Miyake |
| 5,665,927 | A | 9/1997 | Taki et al. |
| 5,684,259 | A | 11/1997 | Horii |
| 5,741,990 | A | 4/1998 | Davies |
| 5,831,195 | A | 11/1998 | Nakata |
| 5,908,997 | A | 6/1999 | Arnold et al. |
| 5,936,180 | A | 8/1999 | Ando |
| 6,160,213 | A | 12/2000 | Arnold et al. |
| 6,179,432 | B1 | 1/2001 | Zhang et al. |
| 6,347,998 | B1 | 2/2002 | Yoshitomi et al. |
| 6,401,028 | B1 | 6/2002 | Kamiya et al. |
| 6,516,269 | B2 | 2/2003 | Takeuchi |
| 6,670,535 | B2 | 12/2003 | Anderson et al. |
| 2002/0105359 | A1 | 8/2002 | Shimizu et al. |
| 2002/0134223 | A1 | 9/2002 | Wesley |
| 2003/0015087 | A1 | 1/2003 | Haken |
| 2006/0005693 | A1 | 1/2006 | Nishibori et al. |
| 2006/0236846 | A1 | 10/2006 | Nishibori |
| 2007/0022865 | A1 | 2/2007 | Nishibori et al. |
| 2007/0022868 | A1 | 2/2007 | Nishibori et al. |

FOREIGN PATENT DOCUMENTS

| | | | |
|---|---|---|---|
| EP | 0632427 | A2 | 1/1995 |
| EP | 1710784 | A1 | 11/2006 |
| EP | 1748415 | A2 | 1/2007 |
| EP | 1748418 | A1 | 1/2007 |
| JP | 53-028414 | | 3/1978 |
| JP | 02-074997 | A | 3/1990 |
| JP | 03-182798 | A | 8/1991 |
| JP | 4-285765 | A | 10/1992 |
| JP | 7-325579 | A | 12/1995 |
| JP | 08-006549 | A | 1/1996 |
| JP | 8-110826 | A | 4/1996 |
| JP | 08-221074 | A | 8/1996 |
| JP | 09-068980 | A | 3/1997 |
| JP | 09-212157 | A | 8/1997 |
| JP | 09-319362 | A | 12/1997 |
| JP | 10-097251 | A | 4/1998 |
| JP | 2001-009152 | A | 1/2001 |
| JP | 2001-51681 | A | 2/2001 |
| JP | 2002-175080 | A | 6/2002 |
| JP | 2002-229567 | A | 8/2002 |
| JP | 2003-99039 | A | 4/2003 |
| JP | 2003-177754 | A | 6/2003 |
| JP | 2004-271783 | A | 9/2004 |
| JP | 2004-274570 | A | 9/2004 |
| JP | 2006-20785 | A | 1/2006 |

OTHER PUBLICATIONS

Office Action issued on Nov. 17, 2006 in Japanese Patent Application No. 2004-20689, from which related co-pending U.S. Appl. No. 11/176,645 claims priority.

Office Action issued on Nov. 17, 2006 in Japanese Patent Application No. 2004-200690, from which related co-pending U.S. Appl. No. 11/176,645 claims priority.

Hajime Tachibana Design and NTT Learning systems Corporation released i-Appli that changes cellular phone to music sequencer; disclosed in "Keitai News" on Jan. 16, 2002.

"Tenori-On" disclosed in "The World of Digital Stadium Curator", pp. 1-7, on the internet (www.nhk.or.jp/digista/lab/digista_ten/curator.html.) May 2005.

Japanese Office Action (Decision of Rejection) issued Jan. 30, 2007 in Japanese Patent Application No. 2004-200690 from which related co-pending U.S. Appl. No. 11/176,645 claims priority.

European Search Report for European Patent Application No. EP 06015695 which corresponds to related co-pending U.S. Appl. No. 11/495,467; mailing date of Feb. 6, 2007; pp. 2-12.

Partial European Search Report of European Patent Application No. 06015695 which corresponds to related co-pending U.S. Appl. No. 11/495,467; mailing date of Oct. 26, 2006.

"Yamaha's Tenori-On LED-panel instrument", retrieved from http://www.engadget.com, Weblogs, Inc, 2003-2007.

"Keitai News", retrieved from http://k-tai.ascii24.com/k-tai/new/2002/01/16/632762-000.html, on Jan. 16, 2002, Japan (with English Translation).

Toshio Iwai, "World of Digista Curator", [online], Digital Stadium, Japan (with English Translation) Mar. 29, 2006.

"Tenori-On", retrieved fro http://www.global.yahama.com/design, 2007.

Office Action issued in corresponding European application No. EP 07103475.5, mailed on Jul. 13, 2007.

Notice of Grounds for Rejection issued in Japanese Patent Appl. No. 2005-293369 which corresponds to related co-pending U.S. Appl. No. 11/493,739. Mailing date: Jun. 19, 2007.

KORG Kaoss Pad KP2 Owner's Manual. 2002.

KORG Kaoss Pad KP2 Website; Accessed May 23, 2007. <http://www.korg.com/gear/info.asp?a_prod_no=KP2>.

Propellerhead Reason Operation Manual. Ludvig Carlson, Anders Nodrmark and Roger Wiklander. 2000.

Extended European Search Report of European Patent Application No. 06015696.5-2218, dated Nov. 20, 2006 which corresponds to related co-pending U.S. Appl. No. 11/493,739.

Notice of Grounds for Rejection issued in Japanese Patent Application No. 2005-293369, from which related co-pending U.S. Appl. No. 11/493,739 claims priority. Mailing date of Feb. 27, 2007.

Notice of Grounds for Rejection, issued in Japanese Patent Application No. 2005-109598, from which related co-pending U.S. Appl. No. 11/398,979 claims priority. Mailing date of Feb. 27, 2007.

Notice of Preliminary Rejection issued for Korean Patent Application No. 10-2006-0031407 dated Jan. 24, 2007, which corresponds to related co-pending U.S. Appl. No. 11/398,979.

Extended European Search Report issued for European Patent Application No. 06007180.0/2218, dated Jul. 27, 2006, corresponding to related co-pending U.S. Appl. No. 11/398,979.

Extended European Search Report issued Nov. 13, 2007 in corresponding European Patent Application EP07103475.5.

Notification of the Second Office Action issued in corresponding Chinese Patent Application No. 200710085705.8 dated Sep. 3, 2010.

PERFORMANCE APPARATUS AND TONE GENERATION METHOD

CROSS REFERENCE TO RELATED APPLICATION

This is a continuation of and claims priority from U.S. patent application Ser. No. 11/681,899 filed Mar. 5, 2007, the content of which is incorporated herein by reference.

BACKGROUND OF THE INVENTION

The present invention relates to performance apparatus which execute a music performance in response to user's operation of a plurality of key switches, as well as tone generation methods using the performance apparatus.

Performance apparatus called "TENORI-ON" (trademark) has been known, for example, from Non-patent Literature 1: "Design, tenori-on [searched on Feb. 22, 2005], Internet Homepage of Yamaha Corporation <URL:http://www.yamaha.co.jp/ design, tenori-on/>.

FIG. 1 is a front view of the performance apparatus (TENORI-ON). FIG. 2 is an enlarged front view of a key switch group 10 of the performance apparatus, where hatched circles indicate key switches 100 selected (i.e., selectively operated) by a human operator or user. Because details of the performance apparatus 1 will be later discussed in relation to embodiments of the present invention, only a part of the performance apparatus 1 is explained here.

The key switch group 10 comprises a total of 256 key switches 100 arranged in two dimensions, with 16 key switches in each of two orthogonal (i.e., vertical and horizontal) directions. Each of the key switches 100 is indicated by X and Y coordinates. For example, the left-lower-end key switch 100 is indicated by "mtSW(1, 1)", and the right-upper-end key switch 100 is indicated by "mtSW(16, 16)".

The key switches 100 of the group 10 are assigned respective tones. For example, different tone pitches are assigned or set in advance to the key switches mtSW(A, 1)-mtSW(A, 16) ("A" represents an integer in the range of values "1"-"16") of each vertical row, to form musical scales. The key switches of each horizontal row represent respective tone generation timing (beat timing); namely, predetermined reproduction timing differences are sequentially set to the key switches mtSW (1, B)-mtSW(16, B) ("B" represents an integer in the range of values "1"-"16") of each horizontal row.

Music performance is executed in this conventionally-known performance apparatus in the following manner. First, a user or human operator selects desired ones of the key switches 100 arranged in two dimensions along the X- and Y-coordinate axes. In the illustrated example, C3(60), D3(62), . . . , D5(86) are sequentially allocated in advance to the key switches mtSW(A, 1)-mtSW(A, 16) of each vertical row, as shown in FIG. 2. Here, numerical values indicated within "()" are numerical values (note numbers) indicating tone pitches.

The performance apparatus 1 creates or forms a music piece data set representative of a music piece as shown, for example, in FIG. 19, on the basis of tone generating data assigned to the selected key switches 100, and then stores the thus-formed music piece data into a memory.

FIG. 19 is a diagram showing an image of music piece data obtained when the key switches 100 have been selected or operated by the user in a pattern as illustrated in FIG. 2.

Once the user performs reproducing operation, the performance apparatus 1 reproduces the stored music piece data set. Namely, the tone generating data are sequentially reproduced in accordance with the respective tone generation timing. In the case as shown in FIG. 2 and 19, the tone generating data of the 1st to 16th beats are reproduced in accordance with the predetermined timing; namely, "silent", "F", "silent", "D", . . . , are reproduced at the first beat, second beat, third beat, fourth beat, . . . , respectively. Upon completion of the reproduction of the 16th beat, the performance apparatus 1 returns to the 1st beat to again reproduce the same tone generating data of the 1st to 16th beats.

However, the aforementioned conventionally-known performance apparatus can only sequentially reproduce the tone generating data of the 16 beats corresponding to 16 key switches, arranged in the X-axis direction, in a repeated fashion; namely, in the conventionally-known performance apparatus, the same tone generating data of the 16 beats are merely reproduced repetitively. Therefore, with the conventionally-known performance apparatus, it is difficult to impart complicated variation to the music piece, and thus the music piece reproduced tends to be monotonous and can not give a sufficient feeling of modulation or intonation to the user. Further, with the conventionally-shown performance apparatus, a musical scale once set can not be varied at a later time, which also constitutes causes of the monotonousness and insufficient intonation.

SUMMARY OF THE INVENTION

In view of the foregoing, it is an object of the present invention to provide an improved performance apparatus and tone generation method which allow a repeat pattern and musical scale (i.e., generatable or reproducible tone pitch range) to be varied with simple operation and thereby form complicated music with an enhanced variety and modulation or intonation.

In order to accomplish the aforementioned object, the present invention provides an improved performance apparatus, which comprises: a plurality of key switches arranged in two dimensions along X- and Y-coordinate axes, an X-coordinate position of each of the key switches being associated with tone generation timing, a Y-coordinate position of each of the key switches being associated with a tone pitch; a storage section that stores a music piece data set comprising tone generating data having data of tone pitches and tone generation timing associated with the key switches; a repeat-section setting section that, in a repeat-section setting mode, causes the plurality of key switches to function as setting operators and sets a repeat section of the music piece data set on the basis of the X-coordinate position of any operated one of the key switches; and a reproduction section that reproduces the music piece data set stored in the storage section, the reproduction section repetitively reproducing the tone generating data of the music piece data set included in the repeat section set by the repeat-section setting section.

In a normal mode of performance apparatus of this type, as conventionally known, a plurality of key switches have their X-coordinate positions associated with tone generation timing (beat timing) and their Y-coordinate positions associated with tone pitches. As a human operator or user sequentially depresses desired ones of the key switches in accordance with a desired melody, the tone generating data of the operated key switches are stored into a storage section, and thus, the desired melody can be programmed (or composed). The present invention is characterized in that, when the performance apparatus is in the repeat-section setting mode, the repeat-section setting section causes the plurality of keys witches to function as setting operators and sets a repeat section of the music piece data set on the basis of the X-coordinated positions of the operated key switches. Because the X-coordinated positions of the key switches are associated with tone generating timing (beat timing), the user can easily intuitively know or grasp, on the basis of the key switch arrangement, relationship between a repeat section to be set and the tone generating timing, as a result of which the user can freely and easily set a desired repeat section.

As an example, an X-coordinate position of a start point of the repeat section is set in advance, and the repeat-section setting section determines an end point of the repeat section in accordance with the X-coordinate position of the operated key switch and sets, as the repeat section, a section between the start and end points.

As another example, an X-coordinate position of an end point of the repeat section is set in advance, and the repeat-section setting section determines a start point of the repeat section in accordance with the X-coordinate position of the operated key switch and sets, as the repeat section, a section between the start and end points.

As still another example, the repeat-section setting section determines each of the end and start points of the repeat section in accordance with the X-coordinate position of the operated key switch and sets, as the repeat section, a section between the start and end points.

In the present invention, the reproduction section reproduces tone generating data in a repeated fashion on the basis of the set repeat section. For example, when tone generating data are to be reproduced sequentially rightward from the left end (1st X-coordinate position, i.e. X=1) of FIG. 2, the reproduction section starts the tone generating data reproduction at the left end (1st X-coordinate position, i.e. X=1) and then sequentially reproduces the tone generating data up to a set repeat end point (X=C where C is an arbitrary integer in the range of "1"-"16"). If C=10, the reproduction section sequentially reproduces the tone generating data from one Y-coordinate row corresponding to the 1st X-coordinate position to another Y-coordinate row corresponding to the 10th X-coordinate position. Such a repeat section may be set even during the course of reproduction of the tone generating data, in which case a repetition of the tone generating data repetition based on the newly-set repeat section is effected when the reproduction timing has reached the new repeat section for the first time after the setting of the new repeat section. In this way, the present invention allows the repeat point and hence the repeat section to be varied, to thereby form music with an enhanced variety.

In an embodiment of the present invention, the performance apparatus further comprises a tone-pitch-range setting section that, in a tone-pitch-range setting mode, causes the plurality of key switches to function as setting operators and sets a reproducible tone pitch range on the basis of the Y-coordinate position of any operated one of the key switches. Here, the reproduction section generates, from among the tone generating data to be repetitively reproduced, only tone generating data having tone pitches within the reproducible tone pitch range set by the tone-pitch-range setting section. Because the Y-coordinated positions of the key switches are associated with tone pitches, the user can easily intuitively know or grasp, on the basis of the key switch arrangement, a reproducible tone pitch range to be set, as a result of which the user can freely and easily set a desired reproducible tone pitch range.

In an embodiment of the present invention, the storage section stores a plurality of music piece data sets in a grouped format, each of one or more music piece data sets grouped into a group being assigned a layer, and the performance apparatus further comprises a music-piece-data-set selection section that, in a layer selection mode, causes the plurality of key switches to function as layer selecting operators and selects one of the layers, on the basis of the Y-coordinate position of any operated one of the key switches, to thereby select, from among the one or more music piece data sets within the group, one music piece data set having the selected layer assigned thereto. Here, the repeat-section setting section sets a repeat section of the music piece data set of the layer, selected by the music-piece-data-set selection section, on the basis of the X-coordinate position of the operated key switch. Such arrangements allow a peculiar repeat section to be set independently for the music piece data set of each layer. By the reproduction section reproducing music piece data sets of a plurality of layers simultaneously in a parallel fashion, the music piece data sets of the plurality of layers, repetitively reproduced based on their respective peculiar repeat sections, can be combined or mixed, so that there can be formed music with an even further complexity and variety.

According to another aspect of the present invention, there is provided an improved performance apparatus, which comprises: a plurality of key switches arranged in two dimensions along X- and Y-coordinate axes, an X-coordinate position of each of the key switches being associated with tone generation timing, a Y-coordinate position of each of the key switches being associated with a tone pitch; a storage section that stores a music piece data set comprising tone generating data having data of tone pitches and tone generation timing associated with the key switches; a tone-pitch-range setting section that, in a tone-pitch-range setting mode, causes the plurality of key switches to function as setting operators and sets a reproducible tone pitch range on the basis of the Y-coordinate position of any operated one of the key switches; and a reproduction section that reproduces the music piece data set stored in the storage section, the reproduction section generating only the tone generating data, included in the music piece data set, having tone pitches within the reproducible tone pitch range set by the tone-pitch-range setting section. In this case too, the Y-coordinated positions of the key switches are associated with tone pitches, and thus, the user can easily intuitively know or grasp, on the basis of the key switch arrangement, a reproducible tone pitch range to be set, as a result of which the user can freely and easily set a desired repeat section reproducible tone pitch range.

In an embodiment of the invention, the storage section stores a plurality of music piece data sets in a grouped format, each of one or more music piece data sets grouped into a group being assigned a layer, and the performance apparatus further comprises a music-piece-data-set selection section that, in a layer selection mode, causes the plurality of key switches to function as layer selecting operators and selects one of the layers, on the basis of the Y-coordinate position of any operated one of the key switches, to thereby select, from among the one or more music piece data sets within the group, one music piece data set having the selected layer assigned thereto. Here, the tone-pitch-range setting section may set a reproducible tone pitch range of the music piece data set of the layer, selected by the music-piece-data-set selection section, on the basis of the Y-coordinate position of the operated key switch.

With the aforementioned arrangements of the present invention, a repeat section of a music piece to be performed can be set as desired with ease, so that a music piece can be readily performed with an increased degree of freedom and with sufficient modulation or intonation. Further, the present invention allows a more complicated music piece to be performed with ease, by combining the settings of the repeat section and reproducible tone pitch range.

The present invention may be constructed and implemented not only as the apparatus invention as discussed above but also as a method invention. Also, the present invention may be arranged and implemented as a software program for execution by a processor such as a computer or DSP, as well as a storage medium storing such a software program. Further, the processor used in the present invention may comprise a dedicated processor with dedicated logic built in hardware, not to mention a computer or other general-purpose type processor capable of running a desired software program.

The following will describe embodiments of the present invention, but it should be appreciated that the present invention is not limited to the described embodiments and various modifications of the invention are possible without departing from the basic principles. The scope of the present invention is therefore to be determined solely by the appended claims.

BRIEF DESCRIPTION OF THE DRAWINGS

For better understanding of the object and other features of the present invention, its preferred embodiments will be described hereinbelow in greater detail with reference to the accompanying drawings, in which.

DETAILED DESCRIPTION OF THE INVENTION

Now, with reference to the drawings, a description will be given about a performance apparatus in accordance with embodiments of the present invention. This performance apparatus includes a plurality of key switches arranged in a matrix on a casing in the form of a substantially-flat rectangular parallelepiped, and it performs a music piece on the basis of selection of a desired number of the key switches. Further, this performance apparatus is constructed to adjust a repeat section, reproducible tone pitch range, etc. of tones to be performed, in accordance with selected combinations of key switches and control switches provided around the key switch group on the casing. Thus, the performance apparatus of the present invention can readily perform a music piece with higher elaborateness and originality and enhanced degree of freedom than the conventionally-known performance apparatus.

Figure 1:
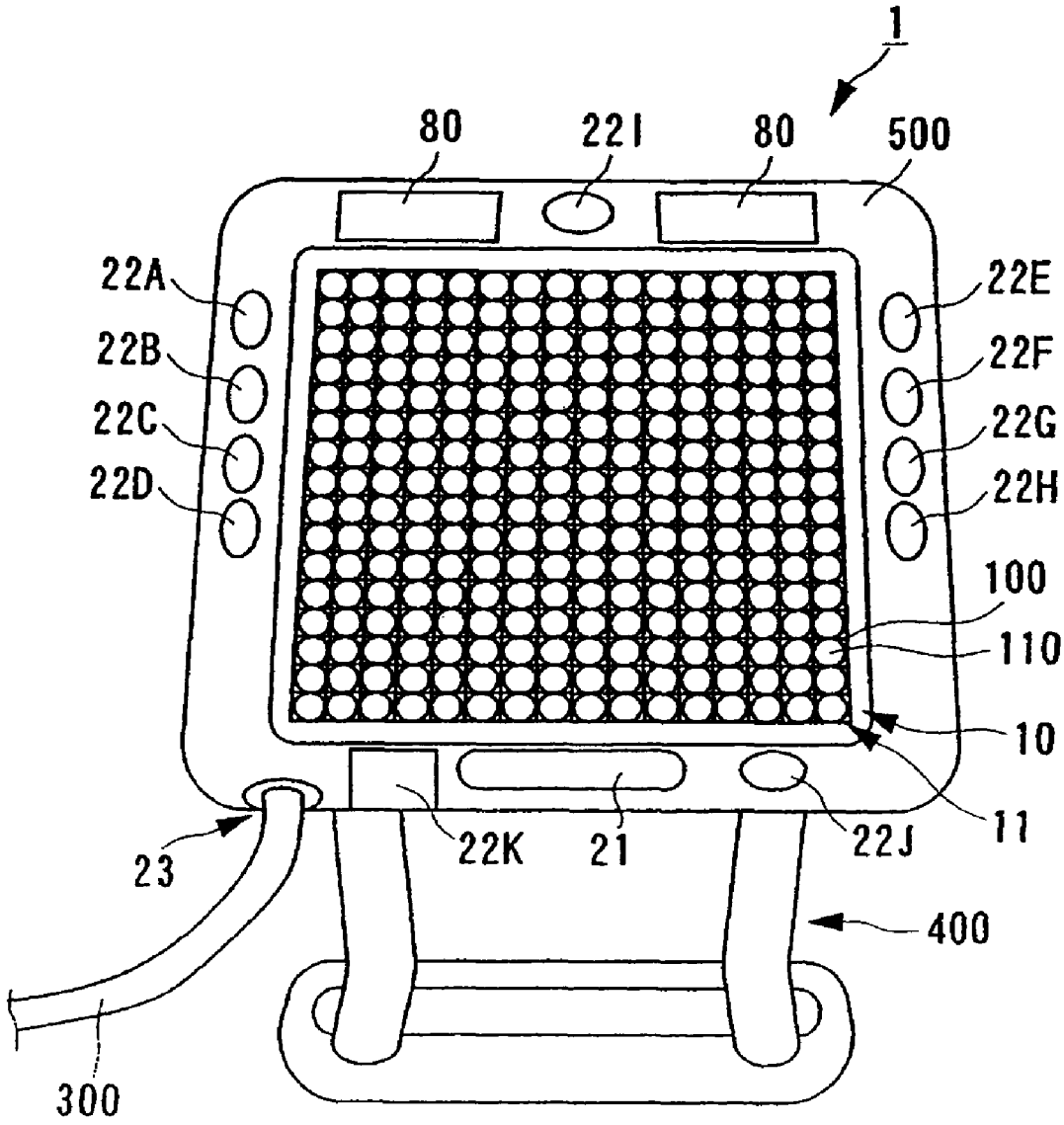
FIG. 1 is a front view of a performance apparatus in accordance with a first embodiment of the present invention.
Figure 2:
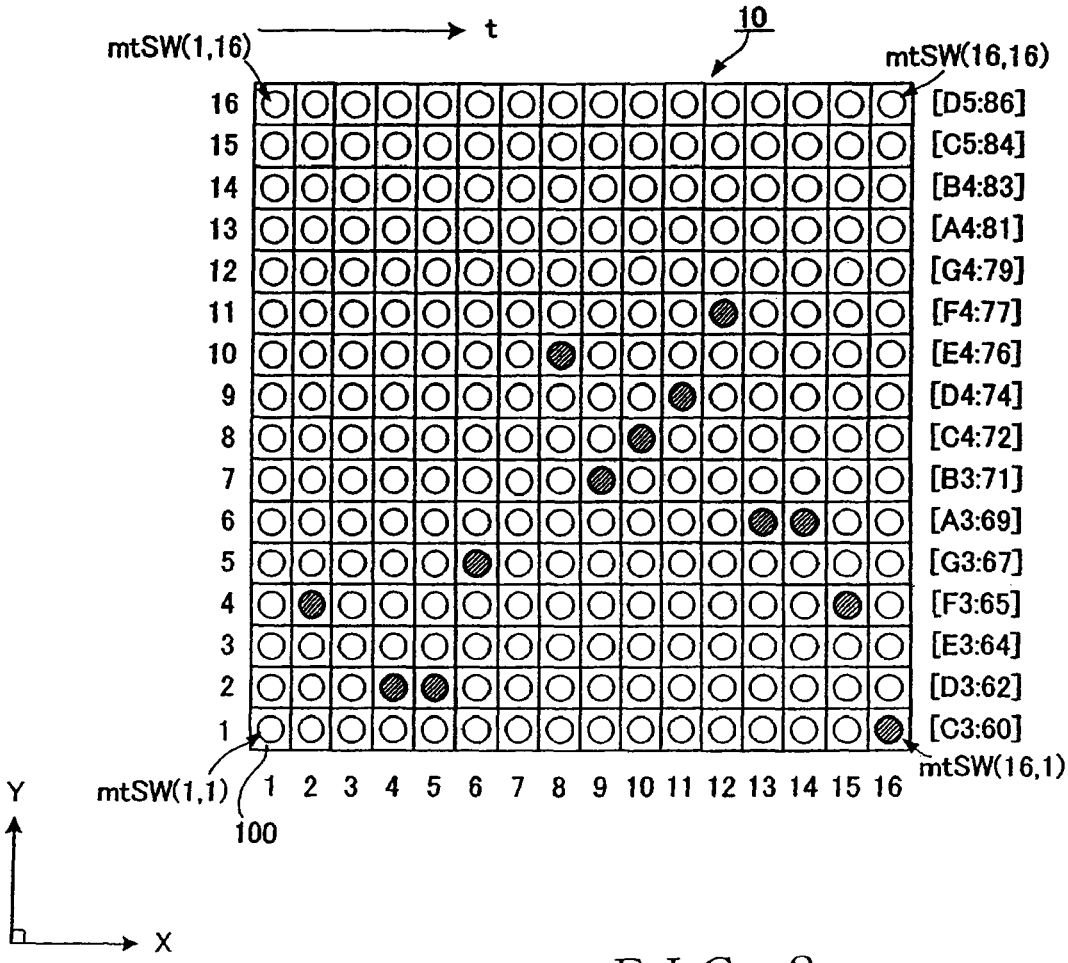
FIG. 2 is an enlarged front view of a key switch group and light-emitting display elements of the performance apparatus as viewed from the front (user side) of the performance apparatus of FIG. 1.

FIG. 1 is a front view of the performance apparatus 1 in accordance with an embodiment of the present invention. FIG. 2 is a view of the key switch group 10 and light-emitting display elements 110 as viewed from the front (i.e., user side) of the performance apparatus 1 of FIG. 1.

The performance apparatus 1 includes the casing 500 in the form of a substantially-flat rectangular parallelepiped and is supported on a stand 400. On the upper surface of the casing 500, there are arranged a plurality of key switches 100 of the key switch group 10 in a two-dimensional matrix. The key switch group 10, provided on the upper surface of the casing 500, comprises a total of 256 key switches 100 arranged in a two-dimensional matrix of the X-Y coordinate system with 16 key switches in each of two orthogonal (i.e., vertical and horizontal) directions of the casing 500.

Each of the key switches 100 is in the form of a push switch with the light-emitting display element 110, including an LED etc., built therein. All of the light-emitting display elements 110 together constitute a light-emitting display element group 11. Each of the light-emitting display elements 110 emits light (i.e., is illuminated) in synchronism with reproduction of tone generating data, assigned to the corresponding key switch 100, during audible reproduction (performance) of a music piece data set. Also, the light-emitting display elements 110 emit light in response to the user depressing the corresponding key switches 100 in any one of various control modes.

Position of each of the key switches 100 of the key switch group 10 and each of the light-emitting display elements 110 of the light-emitting display element group 11 is indicated by two-dimensional coordinates with its position in the vertical direction as a Y-coordinate and its position in the horizontal direction as an X-coordinate.

Control switches 22A-22D are disposed on a left edge portion of the casing 500 located to the left (as the user faces) of the key switch group 10 and light-emitting display element group 11, while control switches 22E-22H are disposed on a right edge portion of the casing 500 located to the right (as the user faces) of the key switch group 10 and light-emitting display element group 11. Further, a control switch 22I and stereo speakers 80 are disposed on an upper edge portion of the casing 500, while control switches 22J and 22K and a liquid crystal display (LCD) section 21 are disposed on a lower edge portion of the casing 500. Further, an input terminal 23, to which is connected one end of a connecting cable 300, is provided on a lower end surface of the casing 500 adjacent to the lower edge portion. The connecting cable 300 is connected at the other hand to another performance apparatus which is a communicating party of the performance apparatus 1, or to a personal computer or the like an application program capable of controlling the performance apparatus 1. Thus, the performance apparatus 1 can communicate with the other performance apparatus via the connecting cable 300 to execute a music performance, or download music piece data from the personal computer.

Figure 3:
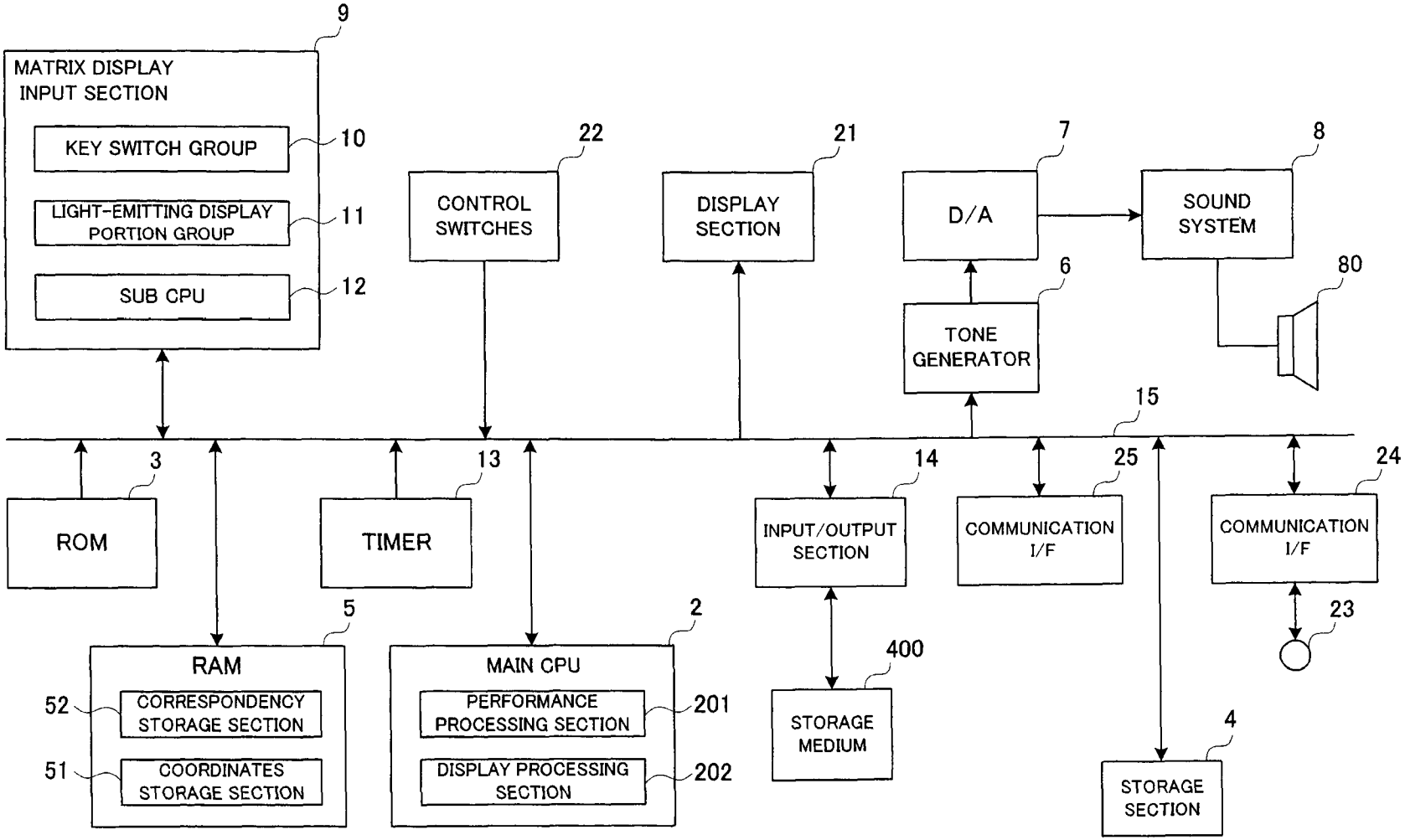
FIG. 3 is a block diagram showing an example electrical setup of the performance apparatus shown in FIG. 1.

FIG. 3 is a block diagram showing an example electrical setup of the performance apparatus 1 shown in FIG. 1.

The performance apparatus 1 includes a main CPU 2, ROM 3, storage section 4, RAM 5, tone generator 6, matrix display input section 9, display section 21, control switches 22, timer 13, input/output section 14, communication interface (I/F) 24 and communication interface (I/F) 25, which are connected with one another via a bus 15.

The ROM 3 has prestored therein a startup program for starting up the performance apparatus 1 and control setting data for each of the control switches 22A-22K.

The control setting data for the control switches 22A-22K include function-setting data for setting a function of the key switches 100 when any one of the control switches 22A-22K has been selected. For example, when the control switch 22D has been depressed (selected), the function-setting data cause the key switches 100 to function as repeat-point adjusting operators, when the control switch 22F has been depressed (selected), the function-setting data cause the key switches 100 to function as reproducible-tone-pitch-range setting operators, or when the control switch 22J has been depressed (selected), the function-setting data causes the key switches 100 to function as hierarchical-music-piece-data selecting operators, as will be later described.

The storage section 4 is a rewritable data storage means, such as a flash memory or hard disk. In the storage section 4, there are prestored various programs, such as a performance processing program for causing the performance apparatus 1 to execute a music performance and a music piece data creation program for creating music piece data. The storage section 4 also stores therein tone generation setting data indicative of correspondency between the individual key switches 100 shown in FIG. 2 and tone pitches (note numbers), as well as music piece data created in a manner to be later described.

The RAM 5 functions as a working area for the main CPU 2, which temporarily stores a program and data read out from the storage section 4. Further, the RAM 5 includes a coordinates storage section 51 storing data indicative of the coordinates of the key switch group 10 shown in FIG. 2, and a correspondency storage section 52.

The coordinates storage section 51 stores ON/OFF states of the individual key switches 100. The coordinates storage section 51 comprises a (16×16)-location table of the same arrangement and shape as the key switch group 10 shown in FIG. 2. In the coordinates storage section 51, each of the 16×16 locations corresponding to the key switches 100 is in the form of a one-bit flag. If any one of the key switches 100 has been depressed for a predetermined time length, one of the locations which corresponds to the depressed key switch 100 is set at a value "1" indicating an ON state of the key switch 100. When the location corresponding to the key switch 100 is set at a value "0", the location indicates an OFF state of the key switch 100.

The correaspondency storage section 52 comprises a note number table T storing a list of note numbers to be allocated to the individual switches 100. In the note number table T employed in the instant embodiment, 16 note numbers (60-75), indicative of tone pitches as illustratively shown in FIG. 2, are allocated, through initial setting, to the Y-coordinates (1-16); the same 16 note numbers (i.e., same pitches) are allocated to each of 16 Y-coordinate groups (or columns) corresponding to the X-coordinates (=1-16) so that the same tone pitches are selectable for each of the 16 X-coordinates. Settings of the note number table T can be varied; that is, the note number table T can be updated in response to setting change operation, and such updating of the note number table T is also reflected in the tone generation setting data of the storage section 4.

The tone generator 6 is, for example, a MIDI tone generator, which generates a digital audio (tone) signal with a predetermined tone color and passes the generated digital audio signal to a D/A converter 7. The tone generator 6 receives, from the main CPU 2, tone color designation (information) based on a note number that is tone generating data and generates a digital audio (tone) signal of the tone color for a predetermined time length (e.g., 200 msec).

The D/A converter 7 converts the digital audio signal, received from the tone generator 6, into an analog audio signal and supplies the converted analog audio signal to a sound system 8. The sound system 8 audibly reproduces or sounds the supplied analog audio signal through a speaker 80.

The matrix display input section 9 comprises the key switch group 10 and light-emitting display element group 11 described above in relation to FIG. 1, and a sub CPU 12.

The sub CPU 12 detects the coordinates of each depressed key switch 100 and supplies the detected coordinates to the main CPU 2 as depressed key switch position information. Also, the sub CPU 12 detects a depressed control switch from among the control switches 22A-22K and outputs data, indicative of the depressed control switch 22A-22K, to the main CPU 2.

The timer 13 counts time to inform the main CPU 2 of the counted time. The input/output section 14 is an interface circuit for exchanging data between a storage medium 140 and the instant performance apparatus 1 (main CPU 2).

The control switches 22 (22A-22K) are operable by the user to give various control instructions for adjusting a repeat point and setting a reproducible tone pitch range (or musical scale with tone pitch limitation). In response to the user depressing a predetermined one of the key switches 100 while depressing a predetermined one of the control switches 22, any of various setting, such as adjustment of a repeat point or setting of a reproducible tone pitch range is performed.

The communication interfaces 24 and 25 are connected, via the bus 15, to the main CPU 2. The communication interface 24 is an interface circuit intended for communication with other equipment connected to the performance apparatus 1 via the input terminal 23 and connecting cable 300 shown in FIG. 1. The communication I/O 25, on the other hand, is an interface circuit intended for communication via a not-shown wide area network, such as the Internet, or LAN.

The main CPU 2, which controls operation of each component connected thereto, executes a tone data reproducing program so as to function as a music piece data formation section 201 and executes a performance program so as to function as a performance processing section 202. In functioning as the music piece data formation section 201 or as the performance processing section 202, the main CPU 2 functions also as a display processing section 203. These programs can be executed in parallel to perform the plurality of functions simultaneously.

In the instant embodiment, a music piece performance can be executed in any one of (1) an automatic performance mode where a music piece is reproduced or automatically performed by reading out prestored music piece data of a music piece composed in advance and (2) a live performance mode where a music piece is performed live in response to the user depressing desired ones of the key switches 100.

(1) Automatic Performance Mode:

The music piece data formation section 201 uses tone generation setting data, stored in the storage section 4, to detect tone generating data corresponding to the key switches 100 depressed (or selected) by the user. More specifically, the music piece data formation section 201 acquires depressed key switch position information from the sub CPU 12 to thereby detect X- and Y-coordinate positions of the user-depressed key switches 100. Then, the music piece data formation section 201 identifies the note numbers corresponding to the Y-coordinate positions of the key switches 100 informed by the sub CPU 12. The music piece data formation section 201 also sets tone generation timing (beat timing) on the basis of the X coordinate positions of the individual depressed key switches 100, and sets tone generating data on the basis of the identified note numbers. In this manner, the music piece data formation section 201 forms or creates a music piece data set having the tone generating data arranged in accordance with predetermined tone generating order. During the formation of such music piece data, the performance processing section 202 uses the tone generation setting data, stored in the storage section 4, to audibly generate tones corresponding to the key switches 100 depressed (or selected) by the user. Thus, the user can compose a music piece while auditorily checking the generated tones. The music piece data created in the aforementioned manner are stored into the storage section 4.

Once it is detected that the user has depressed a music piece reproduction control switch from among the control switches 22, the performance processing section 202 performs an automatic performance process by reading out the designated music piece data set from the storage section 4. The music piece data set includes timing information and note numbers obtained from the X and Y coordinates of the key switches 100, on the basis of which the performance processing section 202 controls the tone generator 6 to sequentially sound the individual note numbers at predetermined timing and with predetermined time lengths.

To execute such an automatic performance, the performance processing section 202 automatically performs (reproduces) the music piece in a repeated fashion (i.e., repeated performance or reproduction). Namely, when sequentially reproducing the music piece data set in accordance with the timing information in the "repeated performance", the performance processing section 202 detects a repeat point, which may be set as desired by the user, and returns, at the detected repeat point, to the beginning of a repeat section of the music piece data set to execute the repeated performance. In a basic mode where the music piece data are sequentially reproduced with no repeat section set by the user, the repeated performance is executed in accordance with timing corresponding exactly to the number of X-axis coordinate positions (16 in the instant embodiment) of the key switches 100.

(2) Live Performance Mode:

When the user has depressed any one of the key switches 100, the sub CPU 12 acquires depressed key switch position information of the key switch 100 as set forth above. On the basis of the acquired depressed key switch position information, the performance processing section 202 detects X and Y coordinates of the user-depressed key switch 100. Then, the performance processing section 202 performs a tone generation process, in which it identifies a note number corresponding to the detected coordinates of the key switch 100 by referring to the note number table T and informs the tone generator 6 of the identified note number. In such a live performance, the depressed key switch position information is also given to the music piece data formation section 201. Thus, the music piece data formation section 201 can also form music piece data on the basis of the depressed key switch position information and store the formed music piece data. The thus-formed music piece data can be subjected to a repeated performance as set forth above.

In each of the automatic performance mode and live performance mode, the performance apparatus according to the instant embodiment not only merely generates tones but also performs light-emitting display in synchronism with a tone generation pattern.

Upon acquisition of the X and Y coordinates of each user-depressed key switch, the display processing section 203 performs a process for controlling the light-emitting display of the light-emitting display element group 11 in synchronism with the tone generation timing in one of the aforementioned performance modes. Namely, the display processing section 203 causes the light-emitting display element 110 of each of the depressed key switches 100 emit light for the same time as the tone generating time length.

Further, once one or more predetermined key switches 100 are depressed by the user with any one of the control switches 22 kept depressed at the time of setting of a repeat point or reproducible tone pitch range (to be later described), the display processing section 203 causes the light-emitting display elements 110, associated with the depressed key switches 10, in a preset light-emitting pattern.

Next, with reference to some of the accompanying drawings, a more detailed description will be given below about how a repeat point is set.

Figure 4:
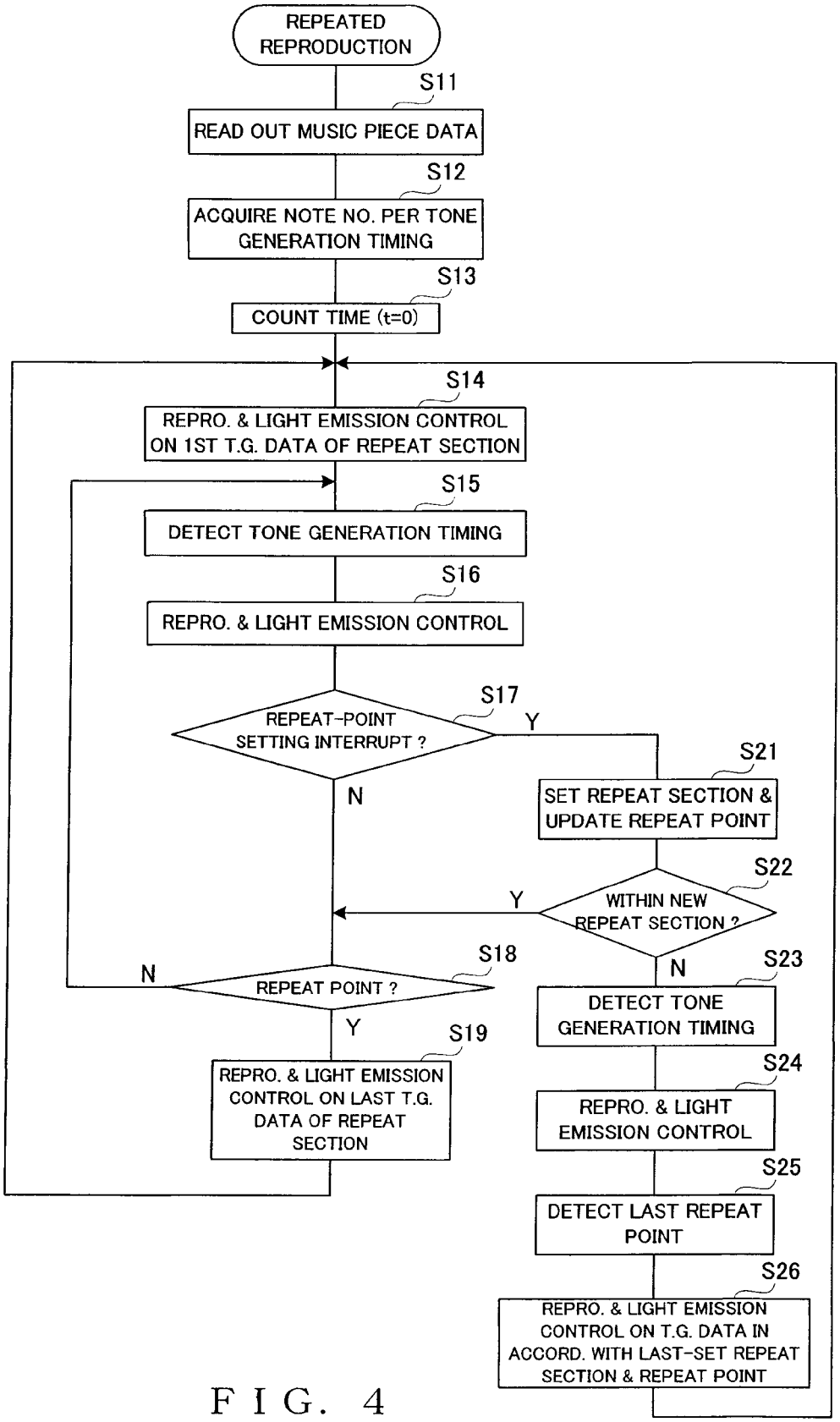
FIG. 4 is a flow chart of a repeated reproduction process performed in the performance apparatus of FIG. 1.
Figure 5:
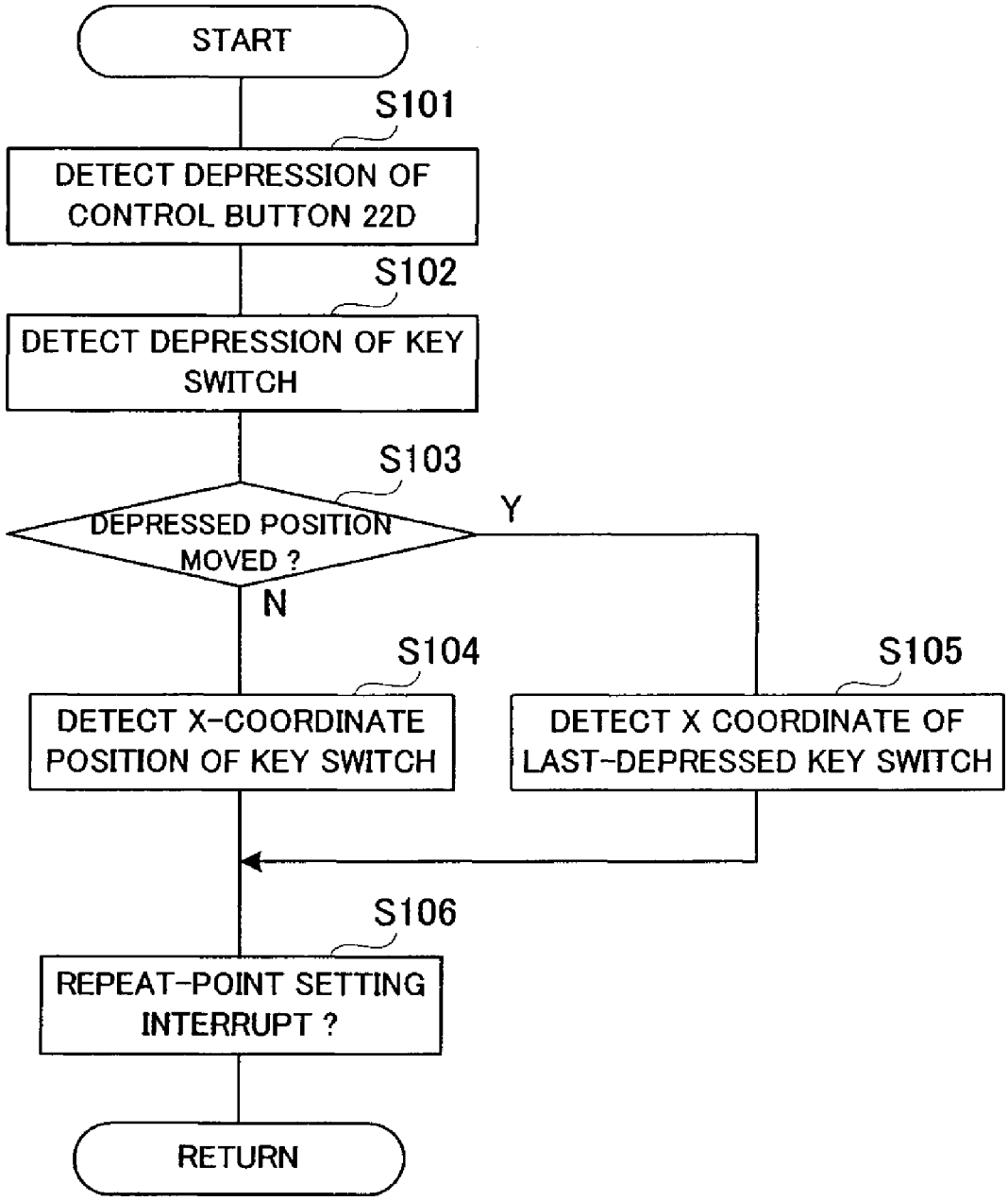
FIG. 5 is a flow chart of a repeat point setting process performed in the performance apparatus of FIG. 1.
Figure 6A:
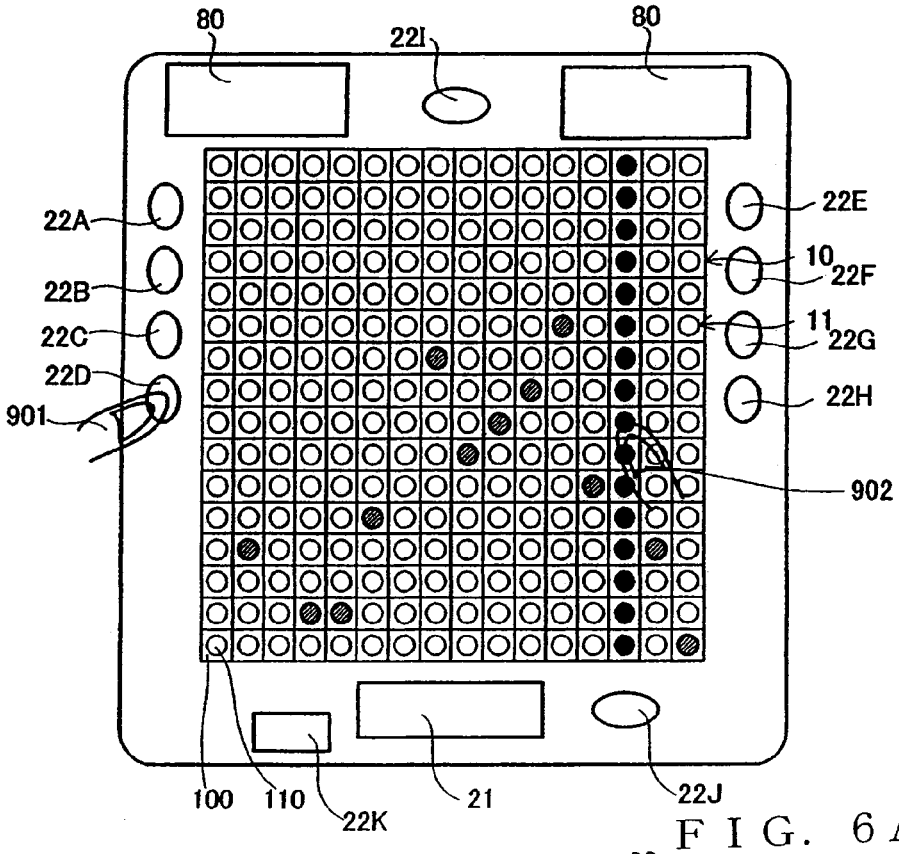
FIGS. 6A and 6B are diagrams explanatory of how a repeat point is set.
Figure 6B:
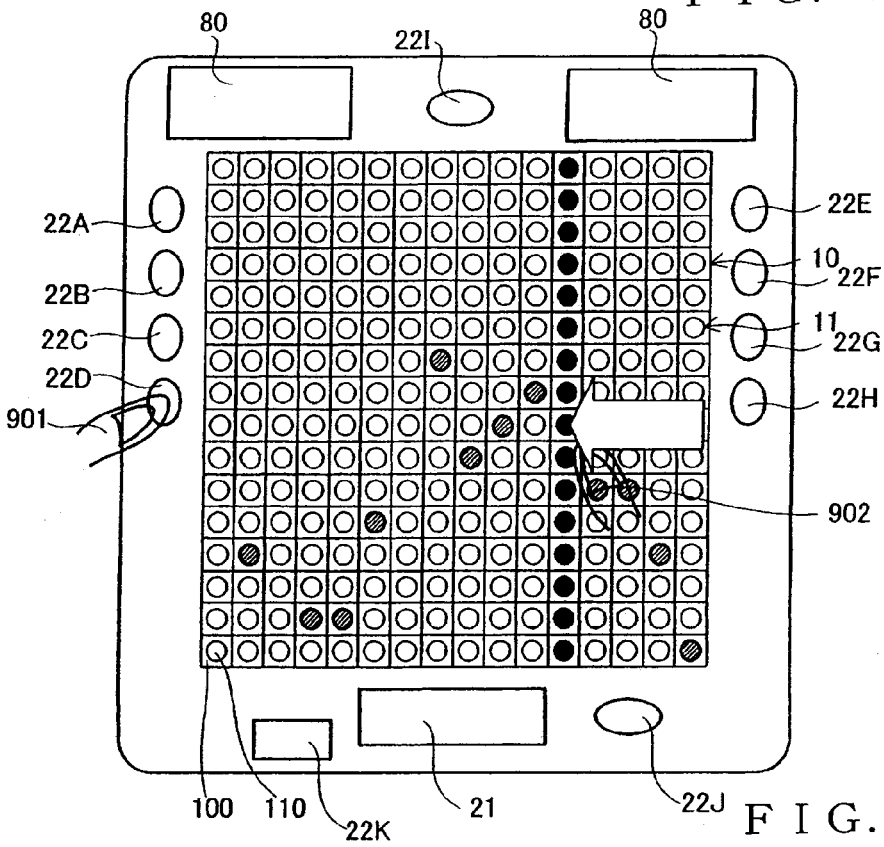
Figure 7A:
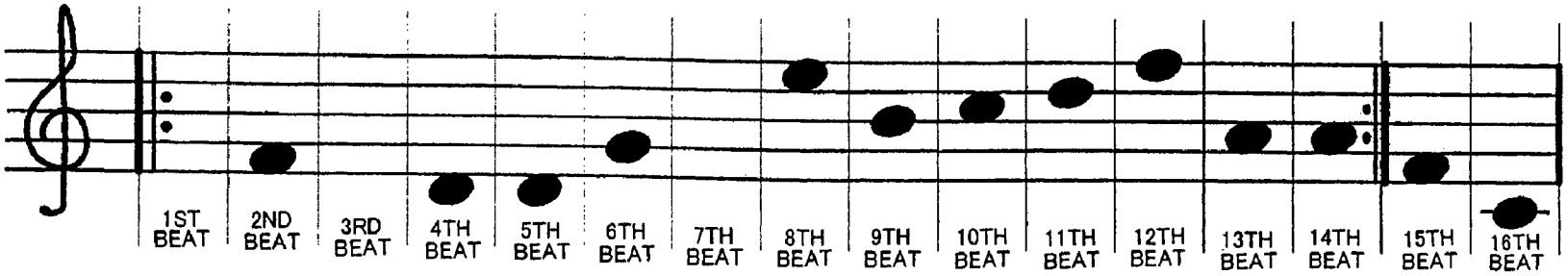
FIGS. 7A and 7B are diagrams showing images of musical scores of music pieces performed in a case where the settings of FIGS. 6A and 6B are implemented.
Figure 7B:
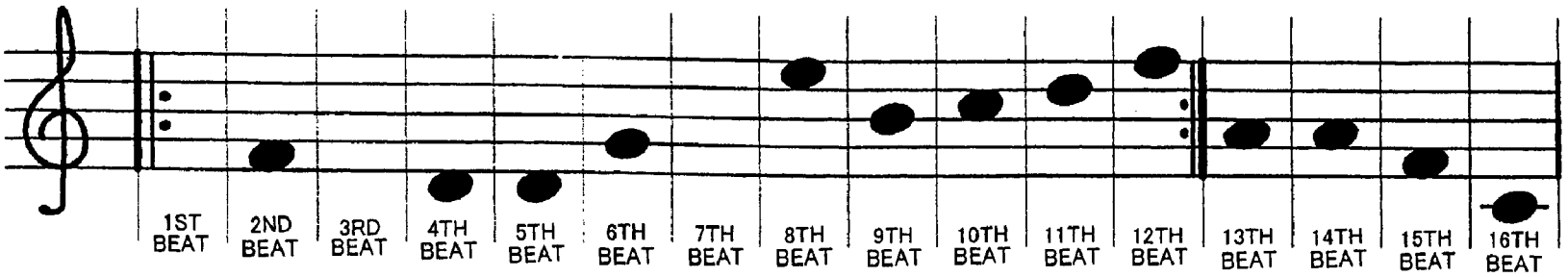

FIG. 4 is a flow chart showing an operational sequence of a repeated reproduction process performed in the instant embodiment, and FIG. 5 is a flow chart showing a repeat section setting process. FIGS. 6A and 6B are views explanatory of how the repeat section is set, and FIGS. 7A and 7B are diagrams showing images of musical scores of music piece data sets performed in cases where the settings of FIGS. 6A and 6B are implemented.

Once automatic reproduction operation is performed by the user, the main CPU 2 reads out music piece data stored in the storage section 4 (step S11). Then, the main CPU 2 acquires individual tone generating data (i.e., combinations of note numbers and tone generation timing) (step S12) from the read-out music piece data, and at the same time, the timer 13 starts counting time (step S13) to output a time count to the main CPU 2 per predetermined timing.

Figure 19:
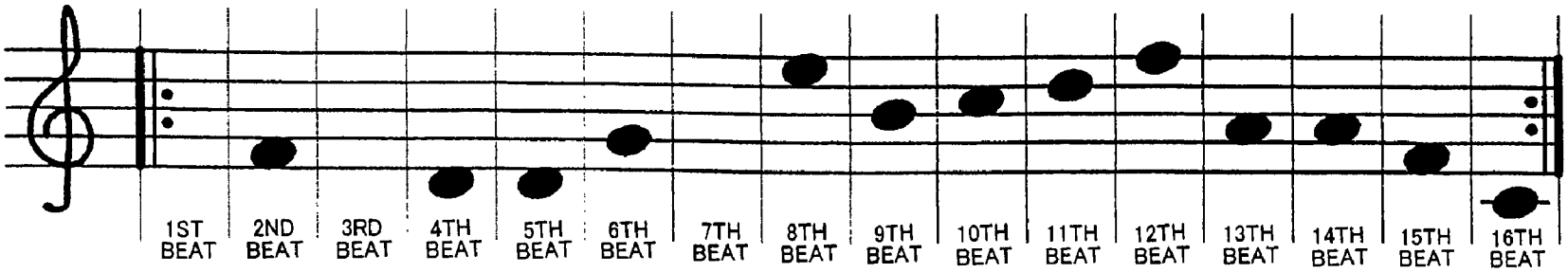
FIG. 19 (PRIOR ART)
FIG. 19 is a diagram showing an image of a music piece performed in a conventionally-known performance apparatus in response to selection of key switches by a human operator or user.

The main CPU 2 performs reproduction control and light emission control on first tone generating (T.G.) data of a repeat section (step S14). If, at that time, no particular repeat section has been set by the user, the main CPU 2 first performs the reproduction control of the first tone generating data in the music piece data. Then, per predetermined timing indicated by the timer 13, the main CPU 2 sequentially performs the reproduction and light emission control on the subsequent tone generating data (step S15→step S16). If no repeat point has been detected, the main CPU 2 continues to execute the reproduction and light emission control on the subsequent tone generating data in order of the second beat, third beat, . . . (step S18→step S15→step S16). Then, once a repeat point is detected, the main CPU 2 performs the reproduction and light emission control on the last tone generating data of the repeat section (step S18→step S19) and returns to the first tone generating data of the repeat section to repeat the reproduction of the successive tone generating data (step S19→step S14). If, at that time, no particular repeat section has been set by the user, the main CPU 2 returns to the tone generating data of the first beat after reproducing the tone generating data of the 16th beat, corresponding to the 16th X-axis coordinate position (i.e., right-end or rightmost key switch in FIG. 2) 100 of the key switch group 10, as the last tone generating data. In the above-described manner, a music piece as illustratively shown in FIG. 19 can be performed.

Throughout such an automatic performance (automatic repeated reproduction), the main CPU 2 constantly monitors whether any one of the control switches 22 has been depressed. Once the user depresses the control switch 22D with a finger 901 in order to set a repeat point, the main CPU 2 detects the depression of the control switch 22D (step S101 of FIG. 5) and activates a repeat-point setting mode in addition to the automatic performance mode. Then, once the user depresses any one of the key switches 100 with another finger 902 while keeping the control switch 22D depressed with the finger 901, the sub CPU 12 detects the depression of the key switch 100 and gives position information of the depressed key switch 100 to the main switch 2 (step S102). Then, the main CPU 2 acquires the position information of the depressed key for a predetermined time and, if there is no change in the depressed position, detects the X coordinate of the depressed key switch from the position information (step S103→step S104). If the user moves the depressed point or position (i.e., depressing finger) from the right-end key switch (i.e., 16th X-axis coordinate position) of the key switch group 10, the main CPU 2 detects the change (or movement) of the depressed position in the key switch group 10 and then detects the X coordinate of the key switch 100 from last depressed by the user (last-detected depressed key switch position information) (step S103→step S105).

The main CPU 2 sets the detected X coordinate position as a repeat point and also interrupts the processing flow of the automatic performance mode of FIG. 4 (step S106). In the processing flow of FIG. 4, the main CPU 2 constantly checks, at step S17, presence/absence of a "repeat-point setting interrupt". Thus, once a repeat point setting interrupt is made at step S106 of FIG. 5 as noted above, a YES determination is made at step S17 of FIG. 4, so that the processing flow branches to step S21.

Upon completion of the repeat-point setting interrupt operation, the main CPU 2 updates the current settings with the thus newly-set repeat point and new repeat section based on the newly-set repeat point.

During that time, the display processing section 203 of the main CPU 2 performs control for illuminating, with a relatively great light intensity, a Y-axis row of the key switches 100 at the X-coordinate position corresponding to the newly-set repeat point (as indicated by black circles in FIG. 6).

Then, the main CPU 2 makes a determination as to whether the current reproduction timing is within the newly-set repeat section, and, if answered in the affirmative (YES determination at step S22), it continues to execute the repeated reproduction as set forth above (step S22→step S18→step S15). Then, once the new repeat point is reached, the main CPU 2 performs the control and light emission control on the last tone generating data of the repeat section (step S18→step S19), and then returns to the first tone generating data of the repeat section to repeat the reproduction of the successive tone generating data (step S19→step S14).

If, on the other hand, the current reproduction timing is not within the newly-set repeat section (NO determination at step S22), the main CPU 2 sequentially performs the reproduction and light emission control on the successive tone generating data in accordance with the last-set repeat section and repeat point (step S23→step S24→step S25→step S26). After that, the main CPU 2 returns to the first tone generating data of the newly-set repeat section to perform the repeated reproduction of the successive tone generating data in the newly-set repeat section (step S26→step S14). In the instant embodiment, the main CPU 2 returns to the tone generating data of the first beat because the first tone generating data of the repeat section is fixed at the first beat of the music piece data set which corresponds to the key switch 100 at the first X-axis coordinate position (i.e., left-end key switch in FIG. 2) in the key switch group 10.

Thus, in the case of FIG. 6A, a music piece as shown in FIG. 7A can be performed with the 14th beat of the music piece data set used as a repeat point and with the 1st to 14th beats as a repeat section. Further, in the case of FIG. 6B, a music piece as shown in FIG. 7B can be performed with the 12th beat of the music piece data set used as a repeat point and with the 1st to 12th beats as a repeat section.

With the above-described arrangements, the instant embodiment allows the repeat point and repeat section to be adjusted as desired even during the course of automatic reproduction. Further, by thus allowing a repeat section to be set as desired, the instant embodiment can execute a music performance full of variety even with a single set of music piece data and thereby give the user a feeling of sufficient modulation or intonation.

Whereas the foregoing has explained the case where adjustment/setting is made of a repeat end point of a music piece data set corresponding to the last position in the repeat section, adjustment/setting may be made of a repeat start point of the music piece data set corresponding to the first position in the repeat section.

Figure 8:
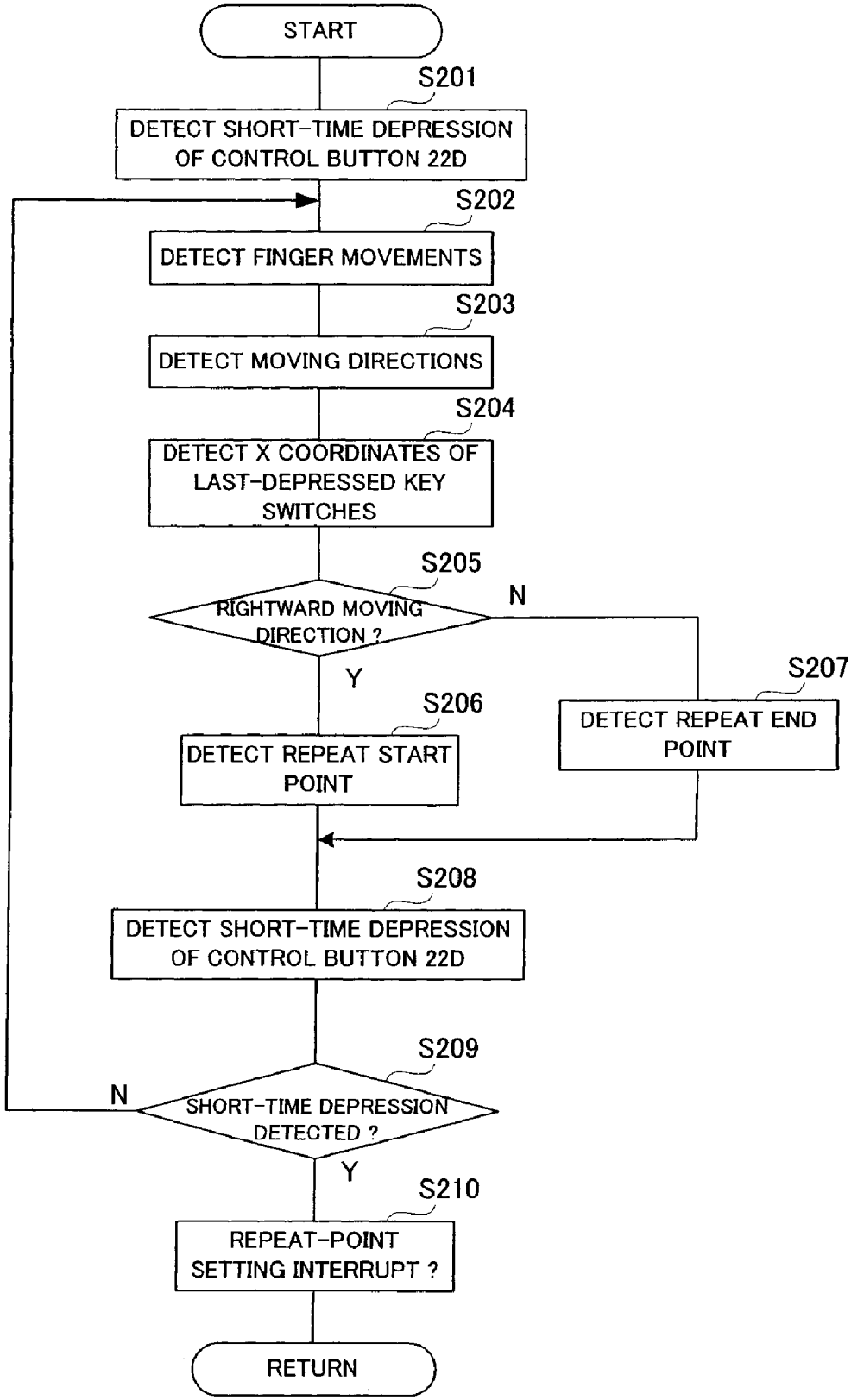
FIG. 8 is a flow chart showing an operational sequence of a repeat point setting process for setting two, i.e. front and rear, repeat points.
Figure 9A:
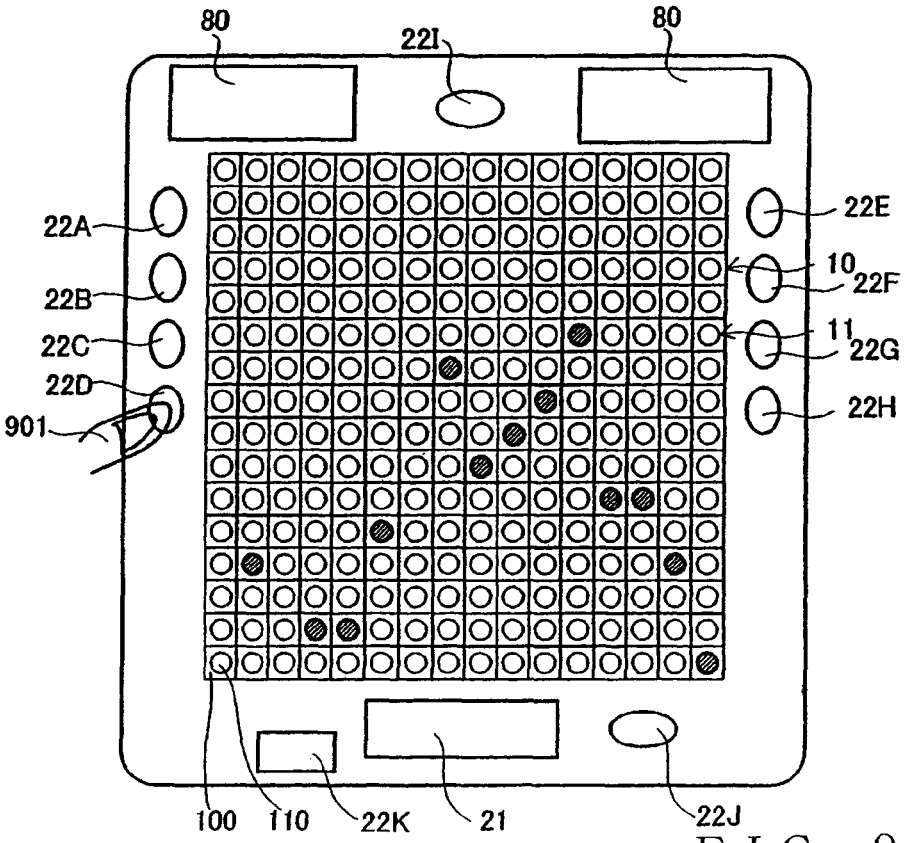
FIGS. 9A and 9B are views explanatory of how two or front and rear repeat points are set.
Figure 9B:
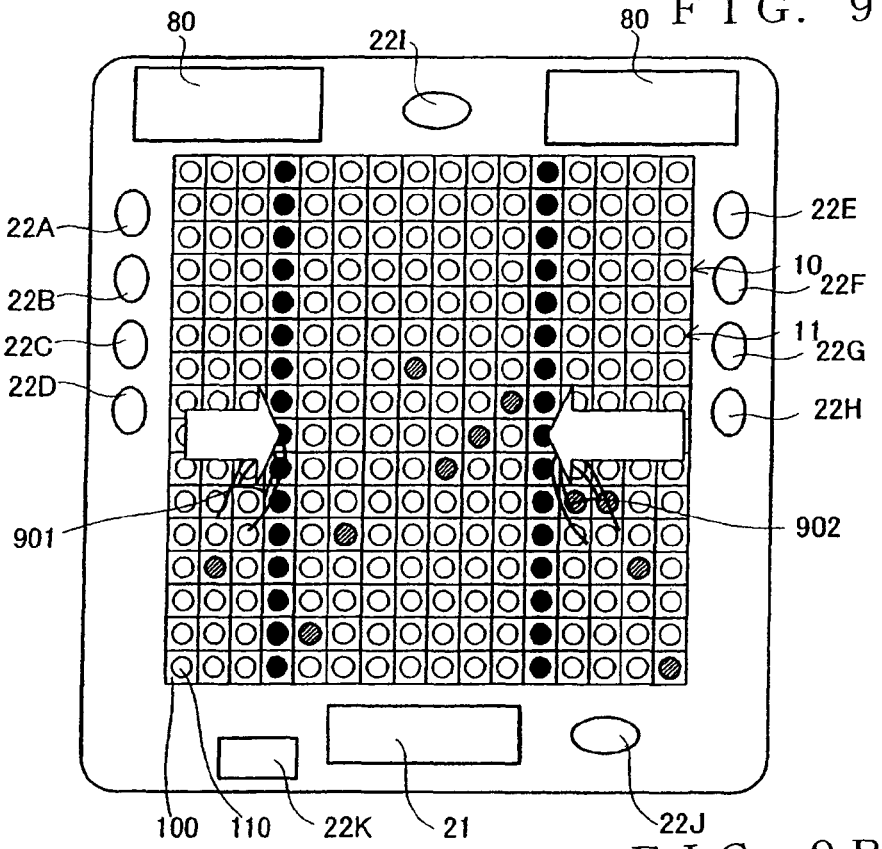
Figure 10:
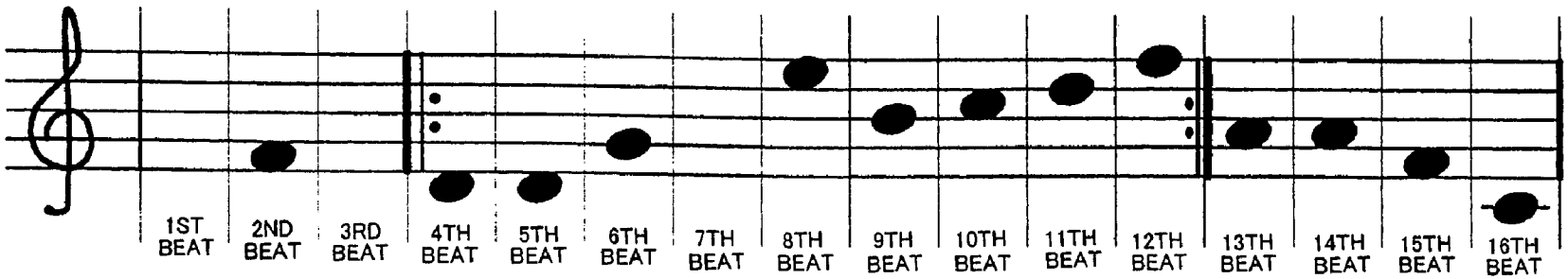
FIG. 10 is a diagram showing an image of a musical score of a music piece performed in a case where the settings of FIGS. 9A and 9B are implemented.

FIG. 8 is a flow chart showing an operational sequence of a repeat point setting process, performed in the instant embodiment, for setting two, i.e. front and rear, repeat points, and FIGS. 9A and 9B are views explanatory of how the two repeat points are set in the repeat point setting process, and FIG. 10 is a diagrams showing an image of a musical score of a music piece performed in a case where the settings of FIGS. 9A and 9B are implemented.

As noted above, the main CPU 2 constantly monitors whether any one of the control switches 22 has been depressed. Once the user depresses the control switch 22D for a short time less than a predetermined time length in order to set a repeat point, the main CPU 2 detects the depression of the control switch 22D and activates a front-and-rear-repeat-point setting mode (step S201 of FIG. 8). Even if the user then releases a finger 901 from the control switch 22D after the depression, the front-and-rear-repeat-point setting mode will last until next time the control switch 22D is depressed for less than the predetermined time length (i.e., a YES determination is made at step S209). Then, as the user successively depresses some of the key switches 100 by moving two fingers 901 and 902 from the opposite ends of the key switch group 10 toward the middle in the X-axis direction, the main CPU 2 detects the finger movements and moving directions of the fingers 901 and 902 (step S202→step S203). Then, once the user stops the finger movements, the main CPU 2 detects the X coordinates of the two last-depressed key switches 100 (step S204). At that time, information indicative of key switch depression trajectories of the two fingers 901 and 902 may be stored in memory so that the movements of the two fingers 901 and 902 depressing the key switches 100 can be identified individually.

By detecting the moving direction and rightward key switch depression trajectory of one of the fingers from the left end toward the middle of the key switch group 10, the main CPU 2 identifies, as a repeat start point, the key switch 100 last depressed by the one finger (step S206). Similarly, by detecting the moving direction and leftward key-switch-depression trajectory of the other finger from the right end toward the middle of the key switch group 10, the main CPU 2 identifies, as a repeat end point, the key switch 100 last depressed by the other finger (step S207). Such operations are carried out by the main CPU 2 until next time the control switch 22D is depressed for a shot time less than the predetermined time length (step S208→step S209→step S202). Upon detection of such next short-time depression of the control switch 22D, the main CPU 2 determines the repeat start point and repeat end point and then performs a repeat-point setting interrupt operation (step S209→step S210). If no repeat start point has been set by the user, the main CPU 2 sets the first X-axis coordinate position as the repeat start point, while, if no repeat end point has been set by the user, the main CPU 2 sets the 16th X-axis coordinate position as the repeat end point.

Then, the main CPU 2 sets a repeat section on the basis of the two repeat points determined through the interrupt operation and carries out operations of steps S21 to S26 of FIG. 4.

If the repeat points are set at the 4th and 12th X-axial key switches 100 (i.e., key switches 100 at the 4th and 12th X-coordinate positions), as shown in FIG. 9B, through the aforementioned operations, the instant embodiment permits a performance of a music piece data set with the 4th beat of the music piece data set used as the first tone generating data (i.e., start-point tone generating data) and the 12th beat of the music piece data set used as the end-point tone generating data.

Because the repeat start and end points of the repeat section can be set as desired in the aforementioned manner, the instant embodiment can perform music pieces even further enhanced variety.

Note that the repeat start and end points may be set in any other suitable manner than the aforementioned; for example, the repeat start and end points may be set at coordinate positions along the X axis by the user merely simultaneously depressing two key switches 100 corresponding to two different X-coordinate positions. In this case too, Y-axis rows of the key switches 100, corresponding to the set start and end points, may be illuminated with a great light intensity.

As set forth above, the instant embodiment permits an automatic selection between the mode where only a "repeat end point" or "repeat start point" is set and the mode where both of a "repeat end point" and "repeat start point" are set, by detecting a difference in the manner the control switch 22D has been operated by the user (i.e., operated manner of the control switch 22D). For example, if the control switch 22D has been depressed for less than a predetermined time, the instant embodiment automatically selects the mode where both of a "repeat end point" and "repeat start point" are set, and carries out the process shown in FIG. 8. On the other hand, if the control switch 22D has been depressed for more than a predetermined time, the instant embodiment automatically selects the mode where only a "repeat end point" or "repeat start point" is set, and carries out the process shown in FIG. 5. In the latter case, if a plurality of the key switches 100 have been operated in the leftward direction (i.e., a finger has moved leftward to successively depress the key switches 100), the instant embodiment may automatically determine that a "repeat end point" is to be set, while, key switches 100 have been operated in the rightward direction (i.e., a finger has moved rightward to successively depress the key switches 100), the instant embodiment may automatically determine that a "repeat start point" is to be set.

The following paragraphs describe a performance apparatus according to a second embodiment of the present invention. The second embodiment is generally similar in construction to the first embodiment, but different from the first embodiment in that it includes a reproducible-tone-pitch-range setting mode not employed in the first embodiment. Therefore, only a reproducible-tone-pitch-range setting process will be explained below.

Figure 11:
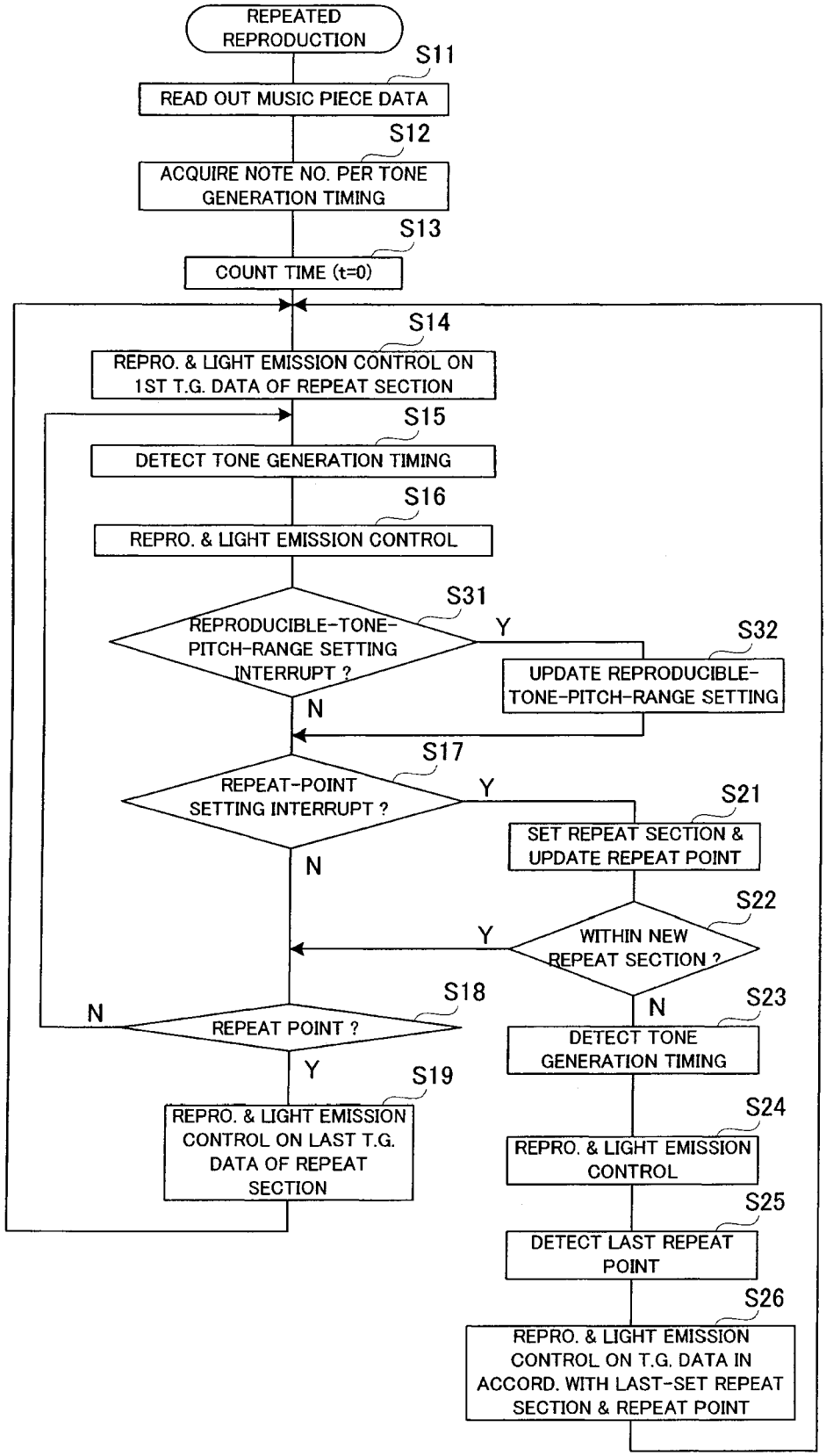
FIG. 11 is a flow chart of processing of an automatic performance mode that includes an interrupt process of a reproducible-tone-pitch-range setting mode.
Figure 12A:
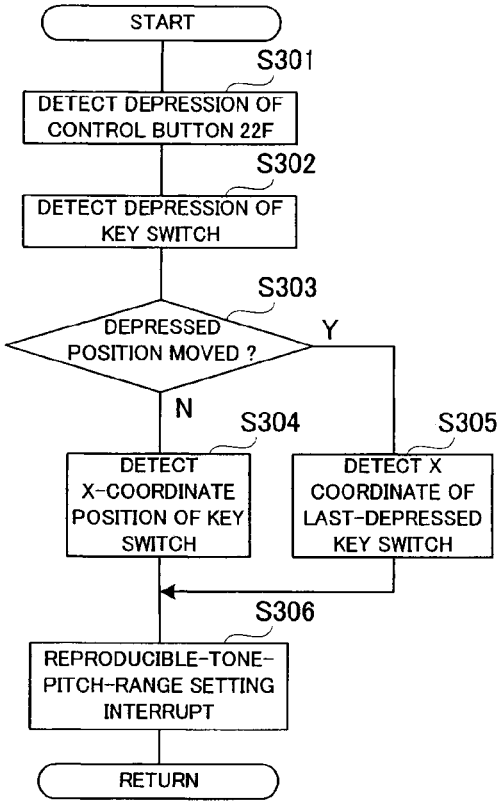
FIGS. 12A and 12B are flow charts showing example operational sequences for setting a reproducible tone pitch range (i.e., reproducing musical scale with tone pitch limitation)
Figure 12B:
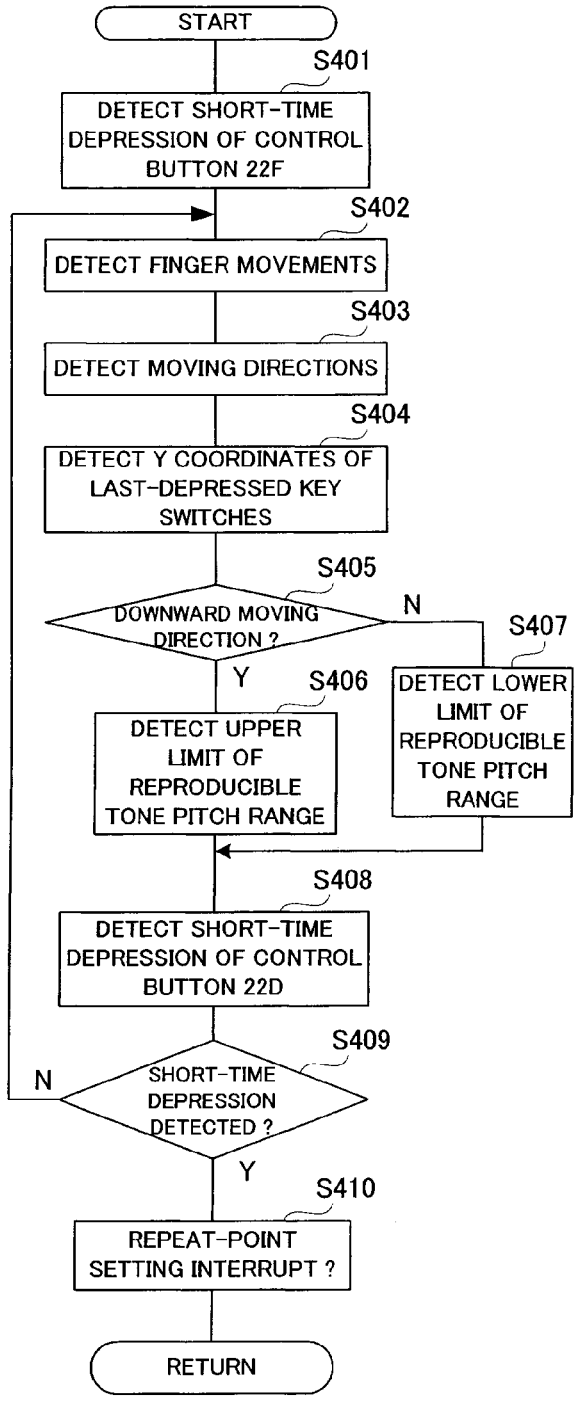
Figure 13A:
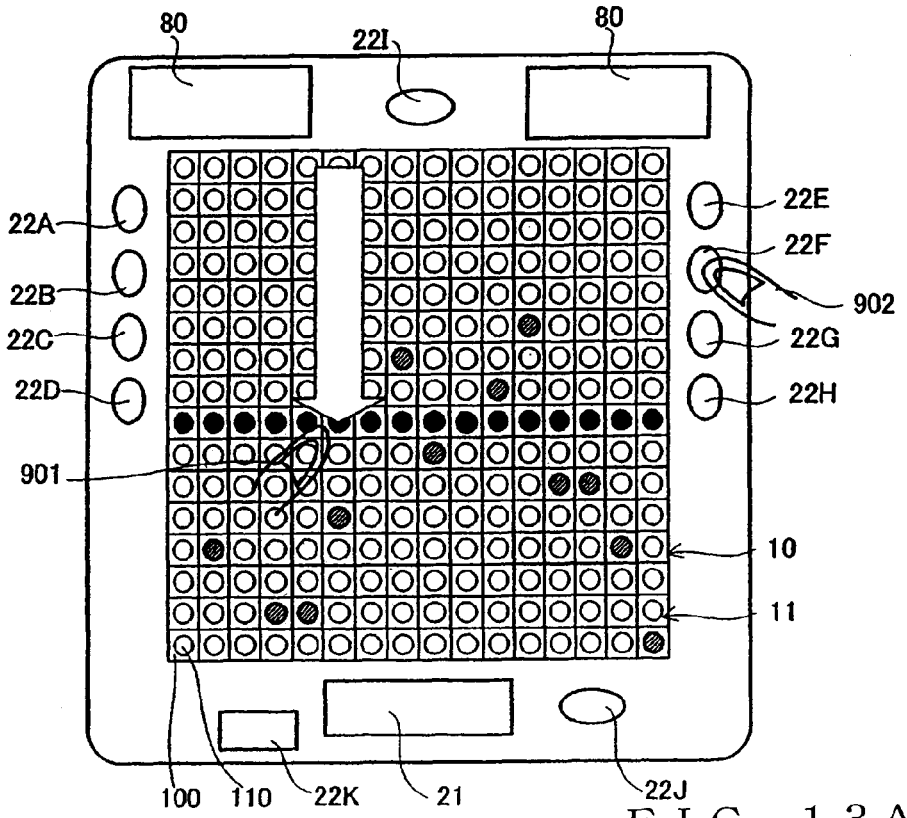
FIGS. 13A and 13B are diagrams explanatory of how a reproducible tone pitch range is set.
Figure 13B:
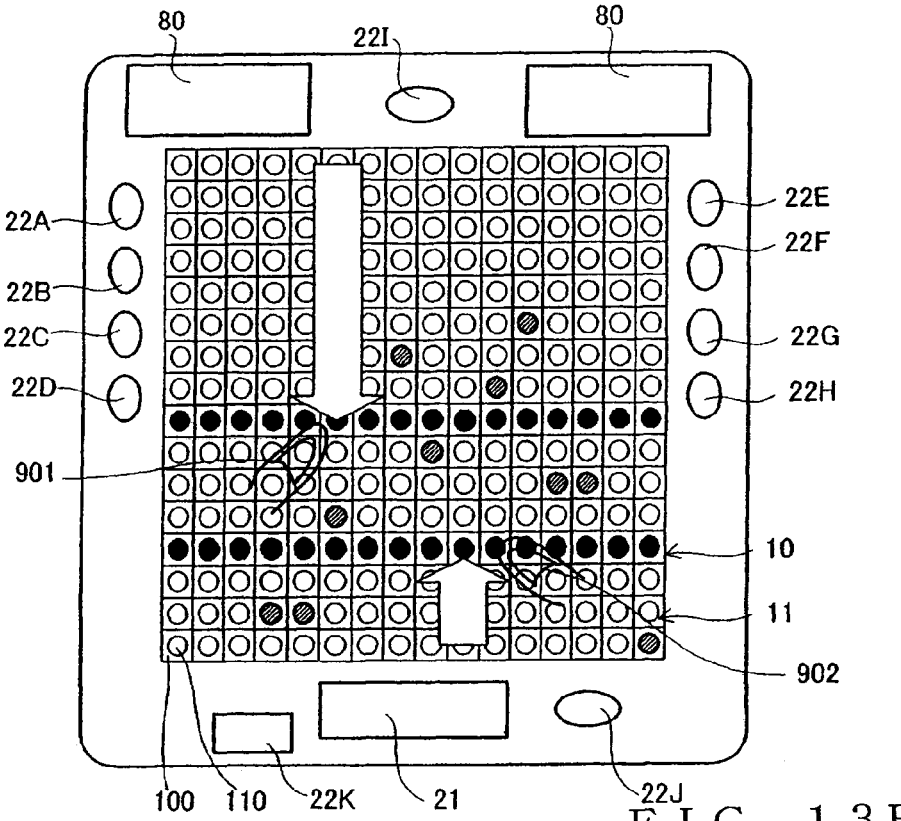
Figure 14A:
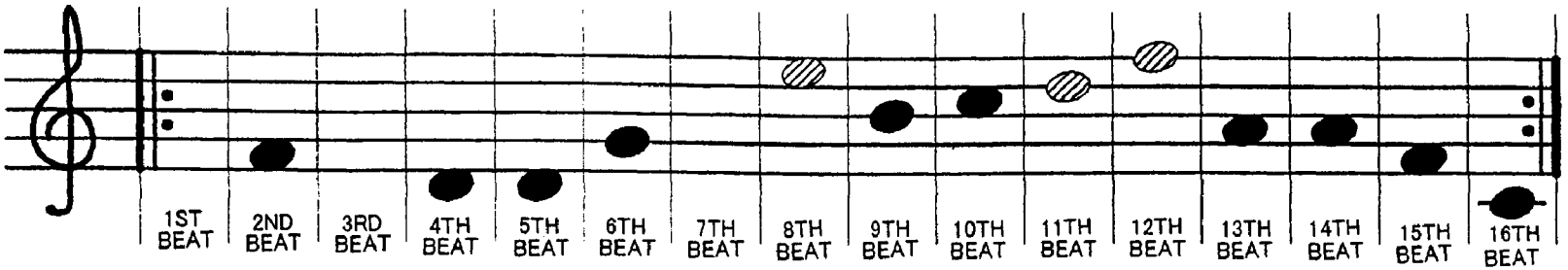
FIGS. 14A and 14B are diagrams showing images of musical scores of music pieces performed in a case where the settings of FIGS. 13A and 13B are implemented.
Figure 14B:
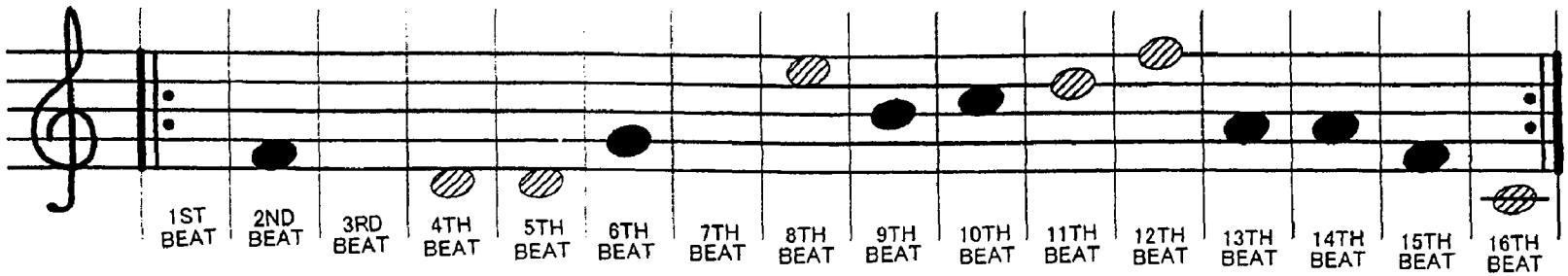

FIG. 11 is a flow chart of an automatic performance mode that includes an interrupt process of the reproducible-tone-pitch-range setting mode. FIGS. 12A and 12B are flow charts showing example operational sequences for setting a reproducible tone pitch range, and FIGS. 13A and 13B are diagrams explanatory of how a reproducible tone pitch range is set, and FIGS. 14A and 14B are diagrams showing images of musical scores of music piece data sets performed in a case where the settings of FIGS. 13A and 13B are implemented.

Although a reproducible tone pitch range can be set even while either the live performance mode or the automatic performance mode is being executed, the following paragraphs explain only the case where a reproducible tone pitch range (or performing or reproducing musical scale) is set during the course of execution of the automatic performance mode.

(1) Setting of Reproducible Tone Pitch Range (i.e., Reproducing Musical Scale with Tone Pitch Limitation) by Depression of Control Switch (FIG. 12A):

The main CPU 2 constantly monitors whether any one of the control switches 22 has been depressed. Once the user depresses the control switch 22F with a finger 902 in order to set a reproducible tone pitch range, the main CPU 2 detects the depression of the control switch 22F and activates the reproducible-tone-pitch-range setting mode in addition to the automatic performance mode (step S301). Then, once the user depresses any one of the key switches 100 with another finger 901 while keeping the control switch 22F depressed with the finger 902, the sub CPU 12 detects the depression of the key switch 100 and gives position information of the depressed key switch 100 to the main switch 2 (step S302). The main CPU 2 acquires the position information of the depressed key for a predetermined time and, if there is no change in the depressed position, detects the Y coordinate of the depressed key switch from the position information (step S303→step S304). If the user moves downward the depressed point from the upper-end key switch (i.e., 16th Y-axial key switch) of the key switch group 10 or moves upward the depressed point from the lower-end key switch (i.e., 1st Y-axial key switch position) of the key switch group 10, the main CPU 2 detects the change (or movement) of the depressed position in the key switch group 10 and then detects the Y coordinate of the key switch 100 last detected by the user (step S303→step S305).

The main CPU 2 sets an upper limit of a reproducible tone pitch range on the basis of the detected Y coordinate and interrupts the processing flow of the automatic performance mode (step S306). Once such a reproducible-tone-pitch-range setting interrupt operation is carried out, the main CPU 2 updates the last reproducible-tone-pitch-range setting with the new reproducible-tone-pitch-range setting (step S31→step S32→step S17).

Thus, if the user sets, for example, only the 8th Y-coordinate position of the key switch group 10, the aforementioned operations can set a musical scale comprising only note numbers "60" to "72" corresponding to the 1st to 8th Y-coordinate positions, so that a music piece data set where, for example, the 8th, 11th and 12th beats are silent beats as illustrated in FIG. 14A can be performed. Alternatively, the Y coordinate detected through the aforementioned operations may be set as the lower limit (end) of a reproducible tone pitch range, in which case the upper limit (end) of the reproducible tone pitch range is set at the 16th Y-axis coordinate position.

(2) Setting of Reproducible Tone Pitch Range (i.e., Reproducing Musical Scale with Tone Pitch Limitation) by Short-Time Depression of Control Switch (FIG. 12B):

As noted above, the main CPU 2 constantly monitors whether any one of the control switches 22 has been depressed. Once the user depresses the control switch 22F with a finger 902 for a short time in order to set a reproducible-tone-pitch-range setting mode in which upper and lower limits of a reproducible tone pitch range can be set (step S401). Even if the user then releases the finger 902 from the control switch 22F after the depression, the reproducible-tone-pitch-range setting mode will last until next time the control switch 22F is depressed for a short time (step S409). Then, as the user successively depresses some of the key switches 100 by moving the fingers 901 and 902 from the upper and lower ends of the key switch group 10 toward the middle in the Y-axis direction, the main CPU 2 detects the finger movements and moving directions of the fingers 901 and 902 (step S402→step S403). Then, once the user stops the finger movements, the main CPU 2 detects the Y coordinates of the last-depressed key switches 100 (step S404). At that time, information indicative of key switch depression trajectories of the two fingers 901 and 902 may be stored in memory so that the movements of the two fingers 901 and 902 can be identified individually.

By detecting the moving direction and downward key switch depression trajectory of one of the fingers from the upper end toward the middle of the key switch group 10, the main CPU 2 identifies, as the upper limit of a reproducible tone pitch range, the key switch 100 last depressed by the one finger (step S406). Similarly, by detecting the moving direction and upward key switch depression trajectory of the other finger from the lower end toward the middle of the key switch group 10, the main CPU 2 identifies, as the lower limit of a reproducible tone pitch range, the key switch 100 last depressed by the other finger (step S407). Such operations are carried out by the main CPU 2 until next time the control switch 22F is depressed for a shot time (step S408→step S409→step S402). Upon detection of such next short-time depression of the control switch 22F, the main CPU 2 determines the upper and lower limits of the reproducible tone pitch range and then performs a reproducible-tone-pitch-range setting interrupt operation (step S409→step S410). If no lower limit of a reproducible tone pitch range has been set by the user, the main CPU 2 sets the first X-axis coordinate position as the lower limit, while, if no upper limit of a reproducible tone pitch range has been set by the user, the main CPU 2 sets the 16th X-axis coordinate position as the upper limit.

After that, the main CPU 2 sets a reproducible tone pitch range on the basis of the upper and lower limits having been obtained through the aforementioned interrupt operation and then carries out operations of steps S31 and S32.

Thus, if the user sets, for example, only the 8th and 4th Y-coordinate positions of the key switch group 10, the aforementioned operations can set a musical scale comprising only note numbers "65" to "72" corresponding to the 4th to 8th Y-coordinate positions, so that a music piece data set where, for example, the 4th, 5th, 8th, 11th, 12th and 16th beats are silent beats as illustrated in FIG. 14B can be performed.

Namely, the second embodiment arranged in the above-described manner can reproduce a single music piece data set with various desired musical scales and thus can reproduce a music piece with enhanced variety. Note that the present invention may be applied to cases where a plurality of music piece data sets are prestored and any one of the prestored music piece data sets is selected and reproduced.

Whereas the second embodiment has been described above in relation to the case where no repeat section adjustment is performed, the second embodiment can reproduce a music piece with a further enhanced variety by performing adjustment of the reproducible tone pitch range and repeat section.

Further, whereas, in the above-described second embodiment, the same reproducible tone pitch range is set for the entire repeat section, the reproducible tone pitch range may be differentiated between start and end portions and intermediate portion of the repeat section. Namely, the repeat section and reproducible tone pitch range may be set as other than a rectangular-shaped section or range in the X and Y coordinate system of the key switch group, such as an oval-shaped section or range. In this way, the second embodiment can reproduce a music piece with an even further enhanced variety.

Figure 15A:
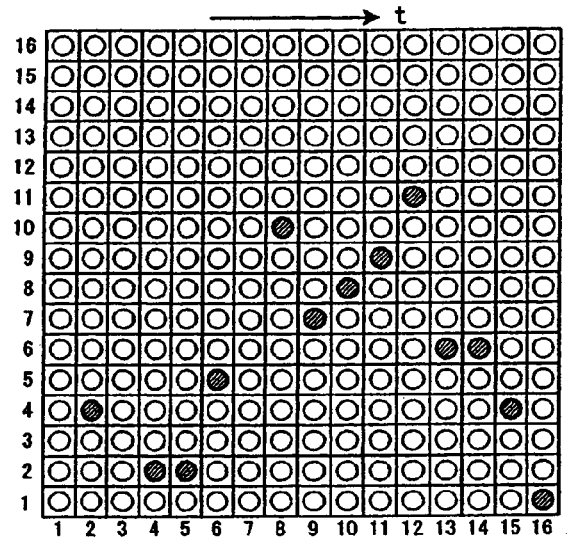
FIGS. 15A-15C are diagrams showing music piece data sets of individual layers, belonging to a group, in a third embodiment of the present invention.
Figure 15B:
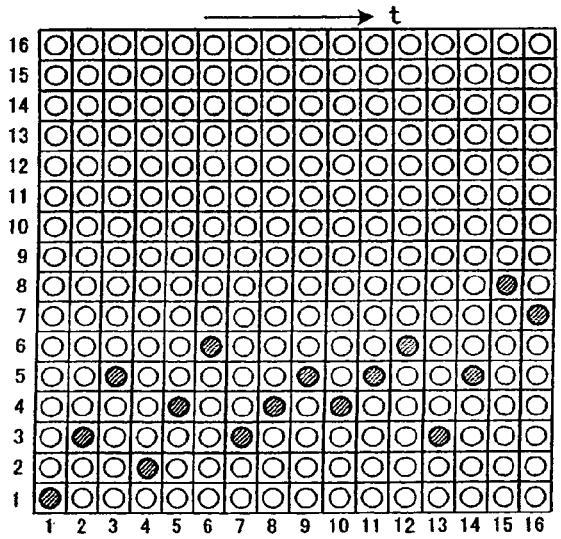
Figure 15C:
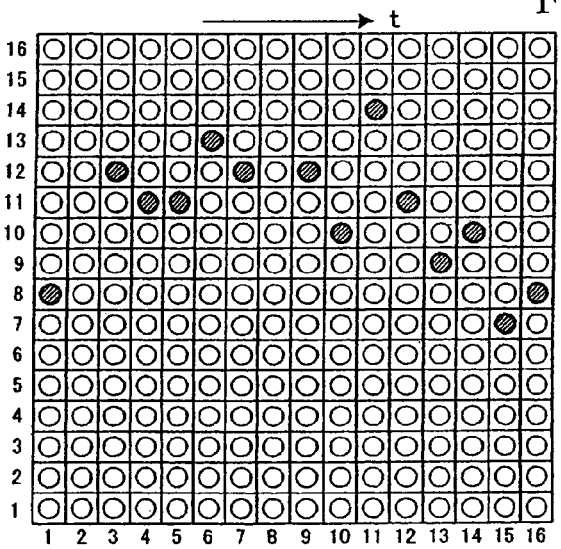

The following paragraphs describe a performance apparatus according to a third embodiment of the present invention, with reference to some of the accompanying drawings. FIGS. 15A-15C show music piece data sets of individual layers, belonging to a group, in the third embodiment of the present invention; more specifically, the music piece data sets are indicated here as coordinate positions of the key switches.

The storage section 4 in the instant embodiment may prestore either only one music piece data as set forth above, or a plurality of music piece data sets in a layered format. In the case where a plurality of music piece data are prestored in a layered format, the music piece data set layers may be grouped, and the music piece data layers may be prestored in the storage section 4 with layer information attached to each of the layers. For example, music piece data sets shown in FIG. 15A, FIG. 15B and FIG. 15C may be prestored in a group as first-, second- and third-layer music piece data sets, respectively, with respective predetermined layer information. Note that the number of such music piece sets to be grouped is not limited to three and may be set to any desired number, such as eight or sixteen.

Figure 16:
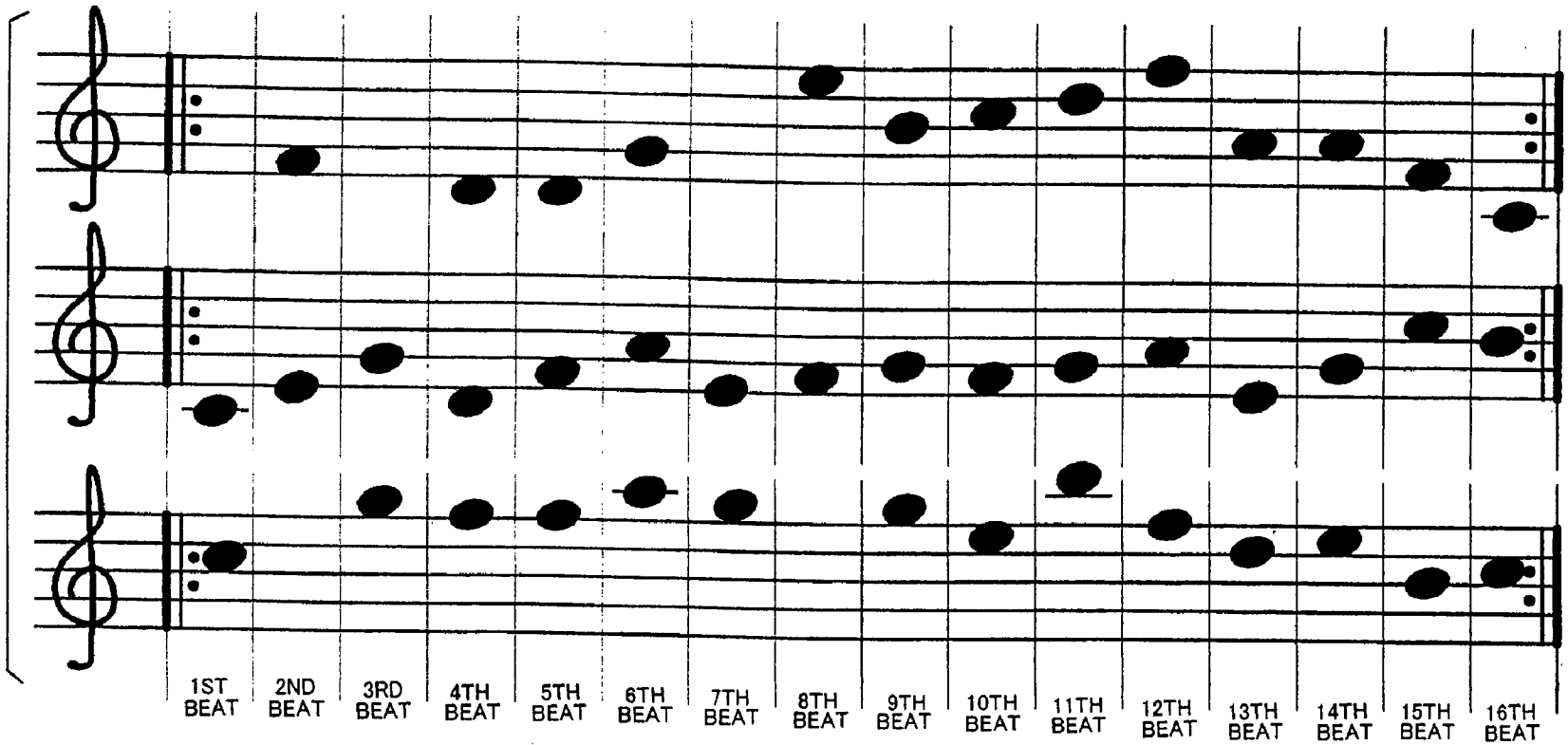
FIG. 16 is a diagram showing images of musical scores of music pieces performed in a case where the settings of FIGS. 15A to 15C are implemented.

Upon receipt of an instruction for reproducing music piece data sets of layers belonging to a particular group, the performance processing section 202 reads out all of the music piece data sets belonging to the group and reproduces the read-out music piece data sets in a parallel fashion, namely, in a manner as illustrated in FIG. 16. FIG. 16 is a diagram showing images of musical scores of music pieces performed in a case where the settings of FIGS. 15A to 15C are implemented.

By layering music pieces in the aforementioned manner, it is possible to reproduce a music piece with an even further enhanced variety.

Each of the music piece data set layers can be subjected to adjustment of a repeat section and reproducible tone pitch range in the following manner.

Figure 17:
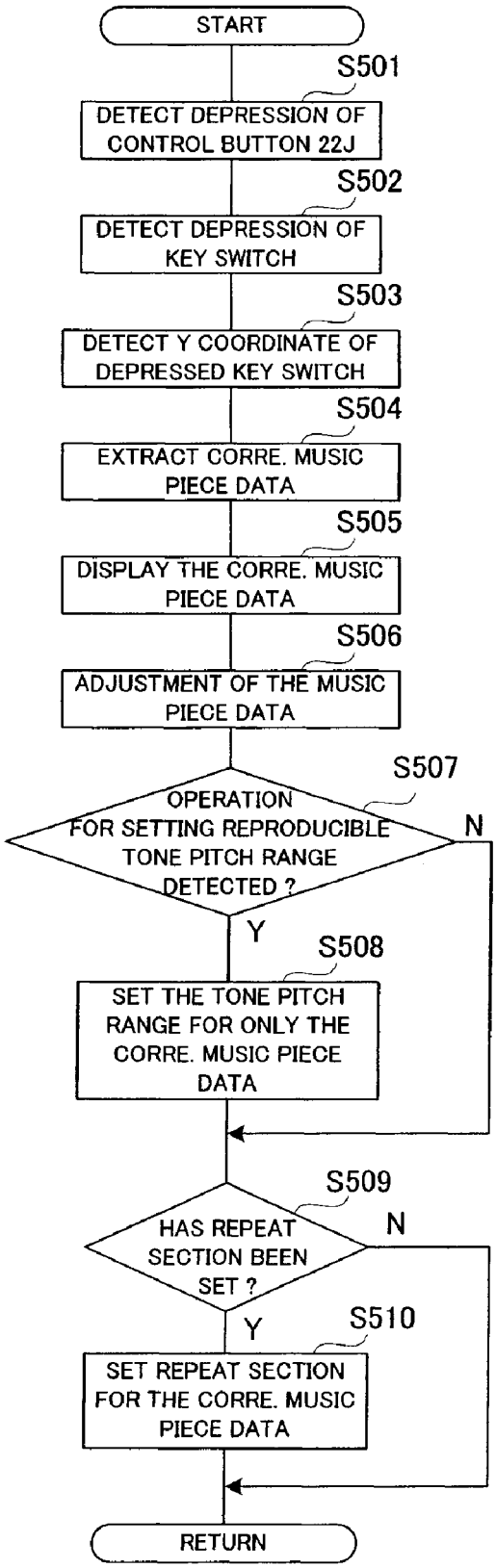
FIG. 17 is a flow chart showing how a repeat section and reproducible tone pitch range of a music piece data set are set.
Figure 18:
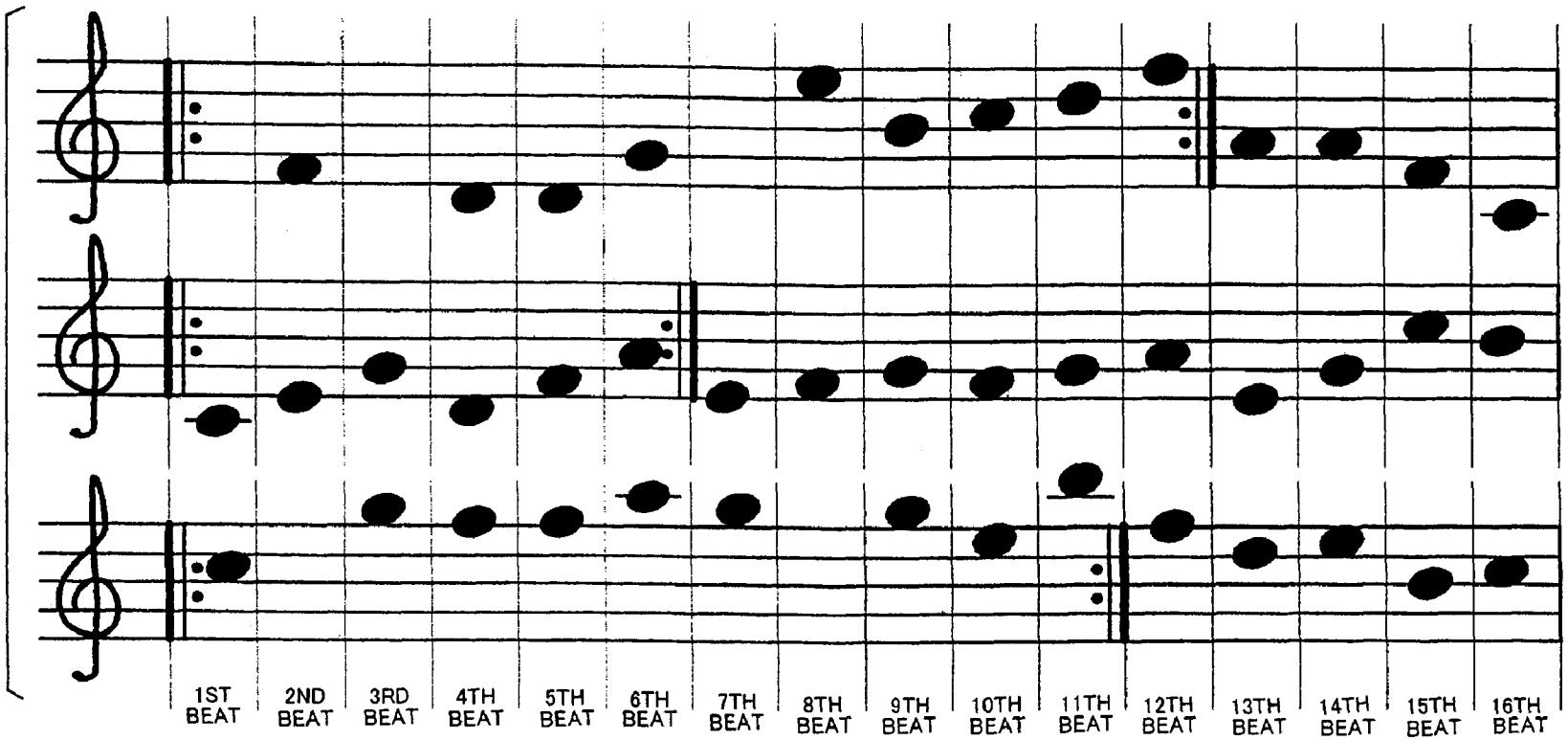
FIG. 18 is a diagrams showing images of musical scores of music pieces performed in a case where different repeat section settings are implemented.

FIG. 17 is a flow chart showing how a repeat section and reproducible tone pitch range of the layered music piece data set are set. FIG. 18 is a diagram showing images of musical scores of music pieces performed in a case where different repeat section settings are implemented.

Once the user depresses the control switch 22J for changing a layer, the main CPU 2 detects the depression of the control switch 22J and activates a layered music piece adjustment mode (i.e., layer selection mode) in addition to the automatic performance mode (step S501). Then, once the user depresses any one of the key switches 100 while keeping the control switch 22J depressed, the sub CPU 12 detects the depression of the key switch and gives position information of the depressed key switch to the main CPU 2 (step S502). The main CPU 2 identifies the Y coordinate of the depressed key switch 100 on the basis of the position information of the depressed key switch 100 (step S503). The Y coordinates of the key switches 100 and the music piece data set layers are associated with each other in advance. For example, Y coordinate "1" is associated with the first layer, Y coordinate "2" with the second layer, Y coordinate "3" with the third layer, and so on.

Then, the main CPU 2 reads out music piece data of a corresponding layer on the basis of the identified Y coordinate (step S504) and outputs the read-out music piece data to the light-emitting display element group 11 (step S505). For example, when the user has depressed the key switch 100 at the 3rd Y-coordinate positions in the key switch group 10, the third layer is selected by the main CPU 2 so that a display is made as illustrated in FIG. 15C. Then, all of the music piece data in the group are reproduced simultaneously with the display of the third layer maintained throughout the reproduction.

Then, once the user performs operation for setting a reproducible tone pitch range (i.e., reproducing musical scale with tone pitch limitation) and a repeat section in the aforementioned state, the main CPU 2 sets a reproducible tone pitch range and repeat section for only the music piece data set of the selected layer in accordance with the user's operation (steps S507-S510). Such reproducible tone pitch range and repeat section setting can be made independently for each of the music piece data layers. In the illustrated example of FIG. 18, 1st to 12th beats are repeated in the first music piece data layer, 1st to 6th beats are repeated in the second music piece data layer, and 1st to 11th beats are repeated in the third music piece data layer. Note that only the music piece data of the currently-selected layer may be subjected to repeated reproduction. Alternatively, repeat sections set for the individual layers may be prestored so that the respective repeat sections of the music piece data of all of the layers in a currently selected group may be subjected to repeated reproduction. Because time lengths of the repeat sections of the individual layers are set independently of one another (i.e., in an uncorrelated manner), the present invention permits music piece reproduction with an enhanced complexity and variety. Further, although not specifically illustrated, reproducible tone pitch ranges (or reproducing musical scales with tone pitch limitation) of the individual layers may be set and stored independently of one another (i.e., in an uncorrelated manner) similarly to the repeat sections, so that music piece reproduction can be performed with an even further enhanced variety.

With the above-described arrangements, a plurality of music piece data sets, having respective repeat sections and reproducible tone pitch ranges set therefor independently of one another, can be reproduced simultaneously in combination, as a result of which a music piece can be reproduced or performed with even further enhanced variety and modulation or intonation.

Furthermore, the foregoing explanations have been made in relation to the case where the Y coordinates are associated with tone pitches, the Y coordinates may be associated with combinations of tone pitches and tone colors. Alternatively, tone data of different tone pitches of one sampled tone may be allocated to the Y coordinates, or various different samples tones may be allocated to the Y coordinates without regard for tone pitches.

What is claimed is:

1. A performance apparatus comprising:

a plurality of key switches arranged in two dimensions along X- and Y-coordinate axes, an X-coordinate position of each of said key switches being associated with tone generation timing, while at a same time, a Y-coordinate position of each of said key switches is associated with a discrete tone pitch;

a storage section that stores a music piece data set comprising tone generating data having data of tone pitches and tone generation timing associated with said key switches;

a repeat-section setting section that, in a repeat-section setting mode, causes the plurality of key switches to function as setting operators and sets a repeat section of the music piece data set on the basis of the X-coordinate position of any operated one of said key switches, wherein when the repeat-setting section sets the repeat section, the repeat-setting section does not set a tone pitch based on the Y-coordinate position of the key switch operated to set the repeat section;

a reproduction section that reproduces the music piece data set stored in said storage section, said reproduction section repetitively reproducing the tone generating data of the music piece data set included in the repeat section set by said repeat-section setting section; and a tone-pitch-range setting section that, in a tone-pitch-range setting mode, causes the plurality of key switches to function as setting operators and sets a reproducible tone pitch range on the basis of the Y-coordinate position of any operated one of said key switches, wherein said reproduction section reproduces, from among the tone generating data to be repetitively reproduced, only tone generating data having tone pitches within the reproducible tone pitch range set by said tone-pitch-range setting section and, consequently, does not reproduce at least part of the tone generating data because the part is outside of the reproducible tone pitch range set by said tone-pitch-range setting section.

2. A performance apparatus as claimed in claim 1 wherein one of upper and lower limits of the reproducible tone pitch range is set in advance, and said tone-pitch-range setting section sets other of the upper and lower limits on the basis of the Y-coordinate position of the operated key switch.

3. A performance apparatus as claimed in claim 2 wherein said tone-pitch-range setting section sets each of the upper and lower limits of the reproducible tone pitch range on the basis of the Y-coordinate position of the operated key switch.

4. A method for generating a tone under control of a computer in a performance apparatus which includes: a plurality of key switches arranged in two dimensions along X- and Y-coordinate axes, an X-coordinate position of each of the key switches being associated with tone generation timing, while at a same time, a Y-coordinate position of each of the key switches is associated with a discrete tone pitch; a storage section that stores a music piece data set comprising tone generating data having data of tone pitches and tone generation timing associated with said key switches; and the computer, said method comprising:

a repeat-section setting step of, in a repeat-section setting mode, causing the plurality of key switches to function as setting operators and setting a repeat section of the music piece data set on the basis of the X-coordinate position of any operated one of the key switches, wherein when the repeat-setting step sets the repeat section, the repeat-setting step does not set a tone pitch based on the Y-coordinate position of the key switch operated to set the repeat section;

a reproduction step of reproducing the music piece data set stored in the storage section, said reproduction step repetitively reproducing the tone generating data of the music piece data set included in the repeat section set by said repeat-section setting step; and a tone-pitch-range setting step of, in a tone-pitch-range setting mode, causing the plurality of key switches to function as setting operators and setting a reproducible tone pitch range on the basis of the Y-coordinate position of any operated one of the key switches, wherein said reproduction step reproduces, from among the tone generating data to be repetitively reproduced, only tone generating data having tone pitches within the reproducible tone pitch range set by said tone-pitch-range setting step and, consequently, does not reproduce at least part of the tone generating data because the part is outside of the reproducible tone pitch range set by said tone-pitch-range setting step.

5. A performance apparatus comprising:

a plurality of key switches arranged in two dimensions along X- and Y-coordinate axes, an X-coordinate position of each of said key switches being associated with tone generation timing, while at a same time, a Y-coordinate position of each of said key switches is associated with a discrete tone pitch;

a storage section that stores a music piece data set comprising tone generating data having data of tone pitches and tone generation timing associated with said key switches;

a tone-pitch-range setting section that, in a tone-pitch-range setting mode, causes the plurality of key switches to function as setting operators and sets a reproducible tone pitch range on the basis of the Y-coordinate position of any operated one of said key switches; and a reproduction section that reproduces the music piece data set stored in said storage section, said reproduction section generating only the tone generating data, included in the music piece data set, having tone pitches within the reproducible tone pitch range set by said tone-pitch-range setting section and, consequently, does not reproduce at least part of the tone generating data because the part is outside of the reproducible tone pitch range set by said tone-pitch-range setting section.

6. A method for generating a tone under control of a computer in a performance apparatus which includes: a plurality of key switches arranged in two dimensions along X- and Y-coordinate axes, an X-coordinate position of each of the key switches being associated with tone generation timing, while at a same time, a Y-coordinate position of each of the key switches is associated with a discrete tone pitch; a storage section that stores a music piece data set comprising tone generating data having data of tone pitches and tone generation timing associated with the key switches; and the computer, said method comprising:

a tone-pitch-range setting step of, in a tone-pitch-range setting mode, causing the plurality of key switches to function as setting operators and setting a reproducible tone pitch range on the basis of the Y-coordinate position of any operated one of the key switches; and a reproduction step of reproducing the music piece data set stored in the storage section, said reproduction step generating only the tone generating data, included in the music piece data set, having tone pitches within the reproducible tone pitch range set by said tone-pitch-range setting step and, consequently, does not reproduce at least part of the tone generating data because the part is outside of the reproducible tone pitch range set by said tone-pitch-range setting step.

* * * * *